US010119359B2

(12) United States Patent
Frazier

(10) Patent No.: US 10,119,359 B2
(45) Date of Patent: Nov. 6, 2018

(54) DISSOLVABLE ALUMINUM DOWNHOLE PLUG

(71) Applicant: MAGNUM OIL TOOLS INTERNATIONAL, LTD., Corpus Christi, TX (US)

(72) Inventor: W. Lynn Frazier, Corpus Christi, TX (US)

(73) Assignee: Magnum Oil Tools International, Ltd., Corpus Christi, TX (US)

( * ) Notice: Subject to any disclaimer, the term of this patent is extended or adjusted under 35 U.S.C. 154(b) by 194 days.

(21) Appl. No.: 14/677,242

(22) Filed: Apr. 2, 2015

(65) Prior Publication Data

US 2015/0285026 A1 Oct. 8, 2015

Related U.S. Application Data

(63) Continuation-in-part of application No. 13/893,205, filed on May 13, 2013, now Pat. No. 9,127,527.
(Continued)

(51) Int. Cl.

| | |
|---|---|
| ***E21B 33/12*** | (2006.01) |
| ***E21B 33/128*** | (2006.01) |
| ***E21B 33/129*** | (2006.01) |
| ***E21B 33/134*** | (2006.01) |
| ***E21B 34/06*** | (2006.01) |
| ***E21B 43/26*** | (2006.01) |

(Continued)

(52) U.S. Cl.
CPC ..... *E21B 33/1291* (2013.01); *E21B 33/128* (2013.01); *E21B 33/134* (2013.01); *E21B 34/063* (2013.01); *E21B 43/26* (2013.01); *E21B 33/16* (2013.01); *E21B 43/116* (2013.01)

(58) Field of Classification Search
CPC .. E21B 33/1291; E21B 33/128; E21B 33/134; E21B 43/26
See application file for complete search history.

(56) References Cited

U.S. PATENT DOCUMENTS 2,348,939 A * 5/1944 Thompson ..... F16J 15/34 277/580
2,695,066 A * 11/1954 Ragan ..... E21B 33/1295 166/120

(Continued)

FOREIGN PATENT DOCUMENTS

JP 2013183363 12/2013
WO 2012121294 9/2012

(Continued)

OTHER PUBLICATIONS

International Search and Written Opinion, Intl. App. No. PCT/US2015/037636, 11 pages dated Sep. 16, 2015.

(Continued)

*Primary Examiner* — David J Bagnell
*Assistant Examiner* — Brandon M Duck
(74) *Attorney, Agent, or Firm* — Jackson Walker, LLP

(57) ABSTRACT

A downhole plug for use in oil and gas well completions made of aluminum, dissolves in natural wellbore fluids, has a dissolvable seal made of aluminum split rings or a degradable elastomer, has a backup pump out ring, and may be provided to the well site as an interchangeable parts kit for adaption to the well's requirements, to provide an interventionless plug in a well.

19 Claims, 36 Drawing Sheets

Related U.S. Application Data

(60) Provisional application No. 61/974,065, filed on Apr. 2, 2014, provisional application No. 62/003,616, filed on May 28, 2014, provisional application No. 62/019,679, filed on Jul. 1, 2014.

(51) Int. Cl.
*E21B 33/16* (2006.01)
*E21B 43/116* (2006.01)

(56) References Cited

U.S. PATENT DOCUMENTS 4,655,247 A 4/1987 Westra et al.
5,224,540 A * 7/1993 Streich ..... E21B 29/00 166/118
5,709,269 A 1/1998 Head
7,093,664 B2 8/2006 Todd et al.
7,900,696 B1 3/2011 Nish
8,211,247 B2 7/2012 Marya
8,694,714 B2 4/2014 Xu et al.
9,127,527 B2 * 9/2015 Frazier ..... E21B 33/129
9,518,442 B2 12/2016 Xu et al.
9,757,976 B2 9/2017 Sherman et al.
2002/0014339 A1 2/2002 Ross
2003/0164237 A1 * 9/2003 Butterfield, Jr. ..... E21B 33/05 166/291
2005/0189103 A1 9/2005 Roberts et al.
2009/0255686 A1 10/2009 Richard et al.
2011/0003930 A1 1/2011 Brunett
2011/0048743 A1 * 3/2011 Stafford ..... E21B 33/134 166/386
2011/0056677 A1 3/2011 Holderman
2011/0067889 A1 3/2011 Marya et al.
2012/0181032 A1 7/2012 Naedler et al.
2012/0292053 A1 11/2012 Xu et al.
2013/0043041 A1 2/2013 McCoy et al.
2013/0048305 A1 2/2013 Xu et al.
2013/0081801 A1 4/2013 Liang et al.
2013/0118759 A1 5/2013 Crews
2013/0199800 A1 8/2013 Kellner et al.
2013/0240200 A1 * 9/2013 Frazier ..... E21B 33/134 166/135
2013/0240201 A1 9/2013 Frazier
2013/0240203 A1 9/2013 Frazier
2013/0300066 A1 11/2013 Xu et al.
2013/0306327 A1 11/2013 Williamson
2013/0319668 A1 12/2013 Tschetter et al.
2013/0319682 A1 12/2013 Tschetter et al.
2013/0333891 A1 12/2013 Fripp et al.
2014/0000894 A1 1/2014 Coffey et al.
2014/0014339 A1 1/2014 O'Malley et al.
2014/0020911 A1 1/2014 Martinez
2014/0027128 A1 1/2014 Johnson et al.
2014/0041857 A1 2/2014 Xu et al.
2014/0060813 A1 3/2014 Naedler et al.
2014/0096970 A1 4/2014 Andrew et al.
2014/0102709 A1 4/2014 Arabskyy
2014/0116677 A1 5/2014 Sherlin
2014/0116721 A1 5/2014 Hofman et al.
2014/0116731 A1 5/2014 Themig et al.
2014/0116775 A1 5/2014 Coffey et al.
2014/0182862 A1 7/2014 Derby
2014/0196899 A1 7/2014 Jordan et al.
2014/0224476 A1 8/2014 Frazier
2014/0224477 A1 8/2014 Wiese et al.
2014/0224506 A1 * 8/2014 Xu ..... E21B 33/134 166/376
2014/0231069 A1 8/2014 VanLue
2014/0231099 A1 8/2014 Barbee et al.
2014/0246189 A1 9/2014 Beason et al.
2014/0246208 A1 9/2014 Themig et al.
2014/0248448 A1 9/2014 Sjostedt
2014/0251594 A1 9/2014 Garcia et al.
2014/0251612 A1 9/2014 Powers
2014/0251636 A1 9/2014 Hofman et al.
2015/0096741 A1 4/2015 Okura et al.
2016/0151831 A1 6/2016 Olsen
2016/0230494 A1 8/2016 Fripp et al.
2016/0230498 A1 8/2016 Walton et al.
2017/0175481 A1 6/2017 Kobayashi et al.
2017/0218720 A1 8/2017 Takahashi et al.
2017/0268307 A1 9/2017 Cooke
2017/0284167 A1 10/2017 Takahashi et al.

FOREIGN PATENT DOCUMENTS

WO 2014098903 6/2014
WO 2014109347 7/2014
WO 2016016628 2/2016
WO 2017082865 5/2017
WO 2017116407 7/2017

OTHER PUBLICATIONS

PCT/JP2015/076150, International Preliminary Report and Written Opinion, 9 pages dated Apr. 6, 2017.

* cited by examiner

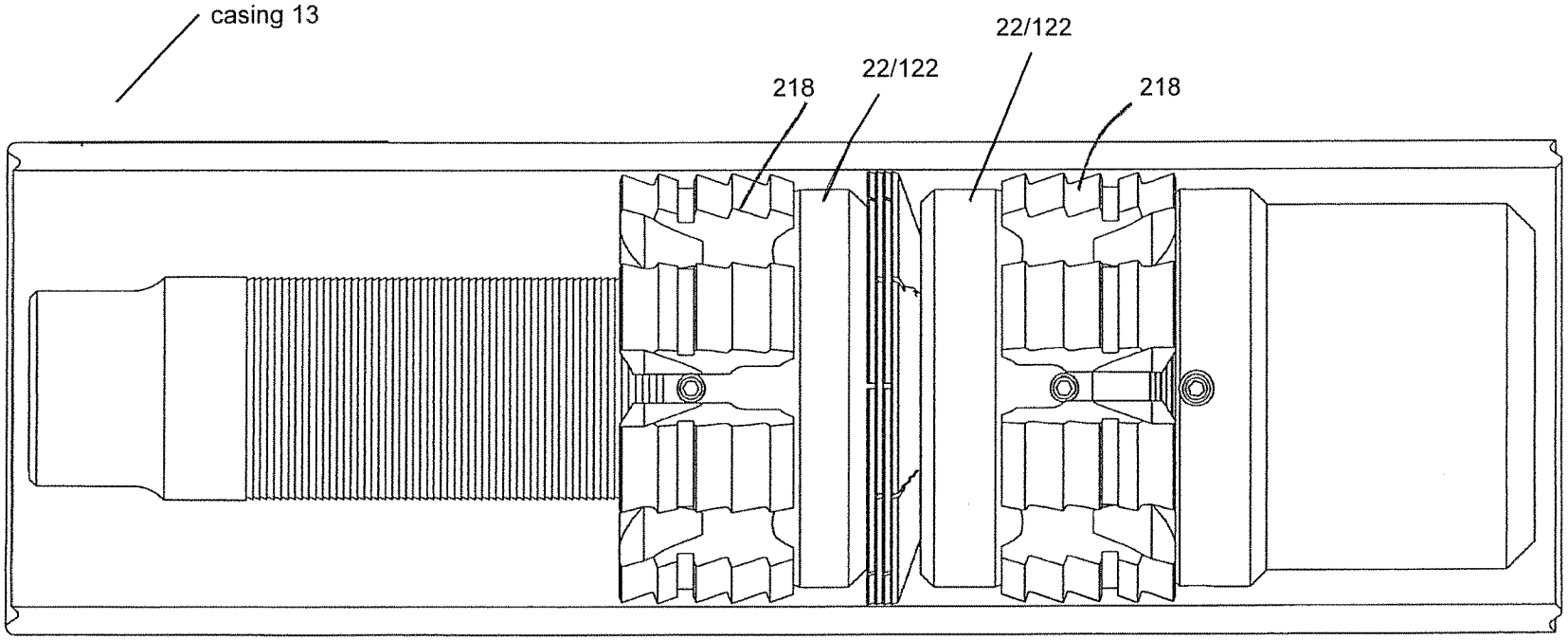
Fig 3E1

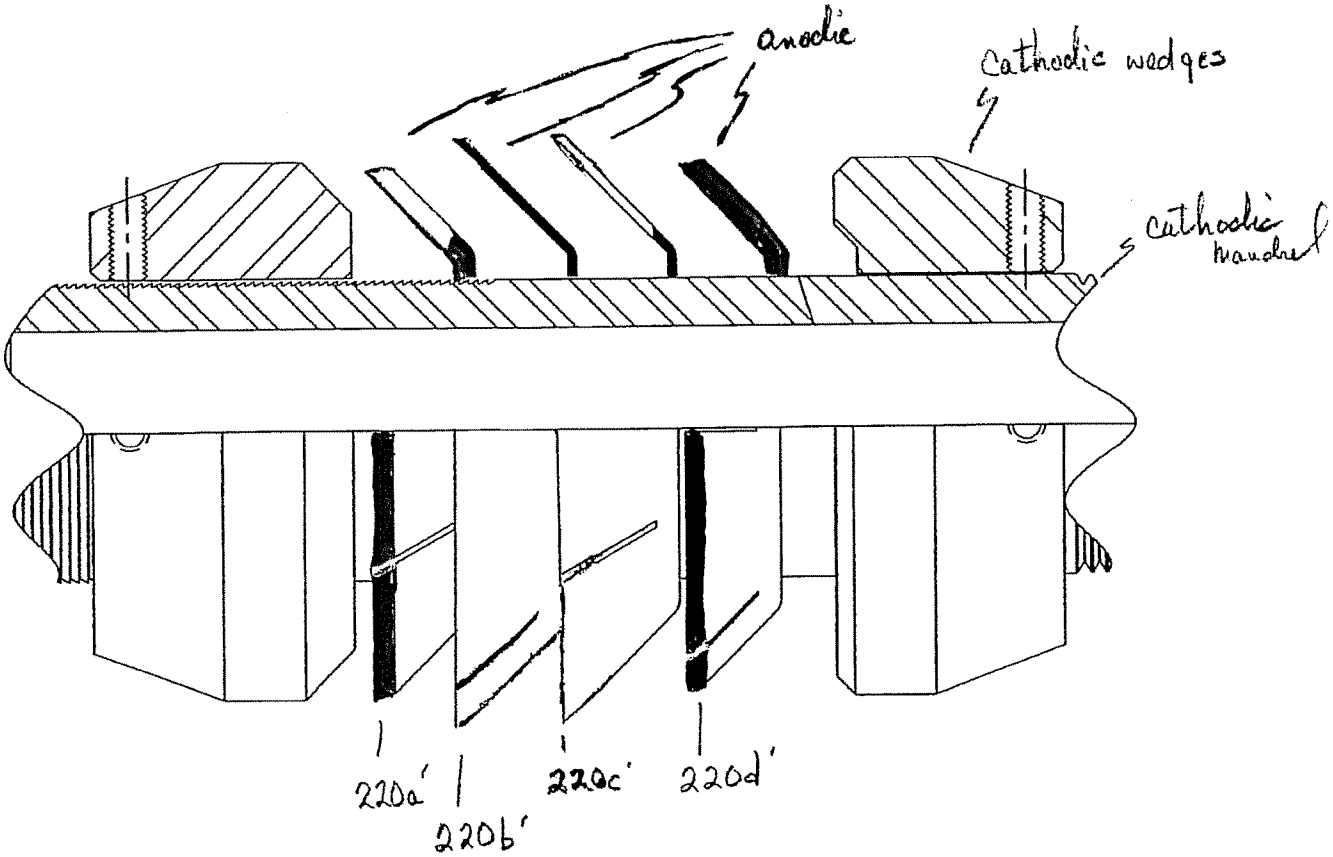
Fig. 3F1

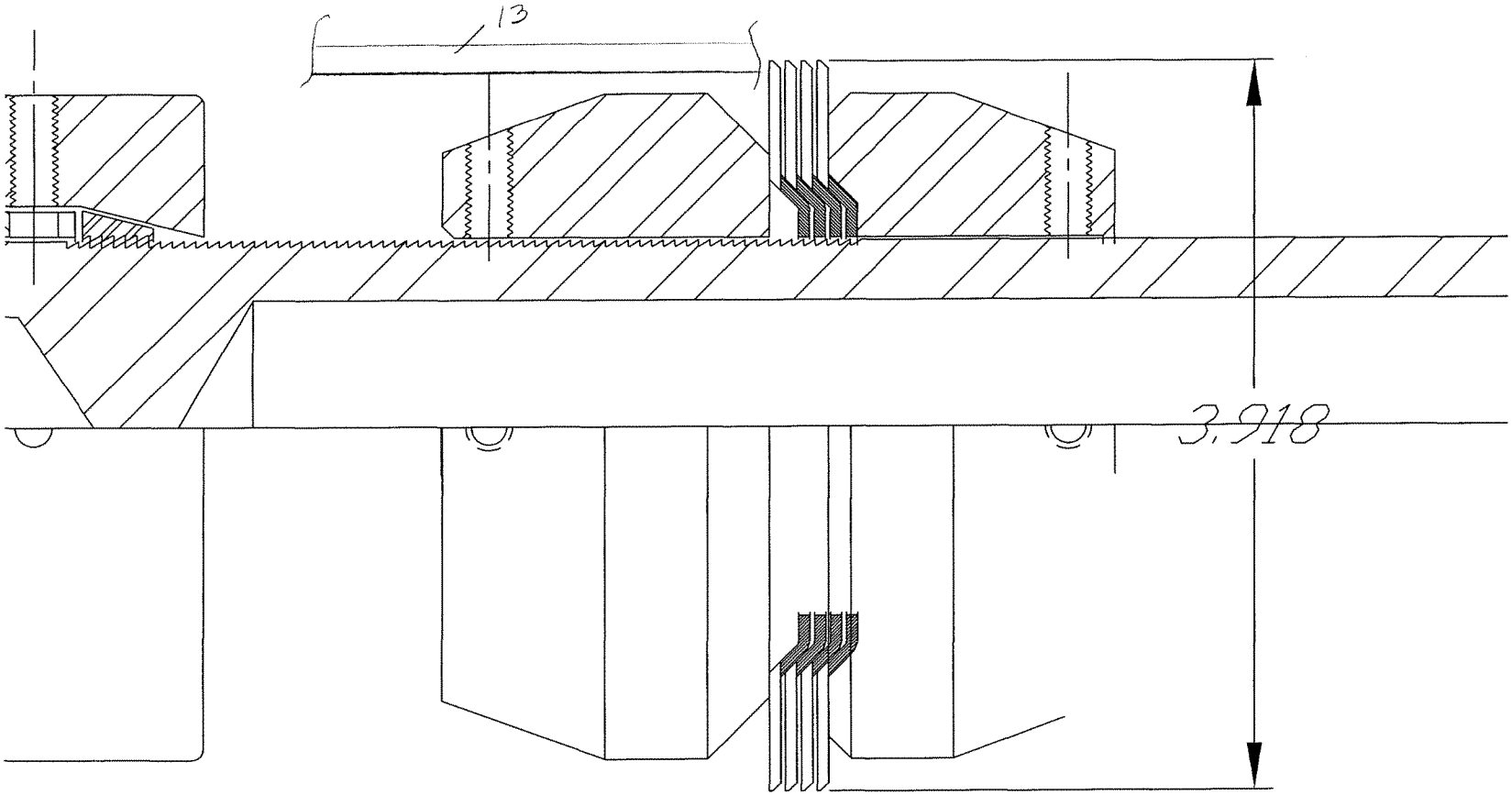
Fig 3F2

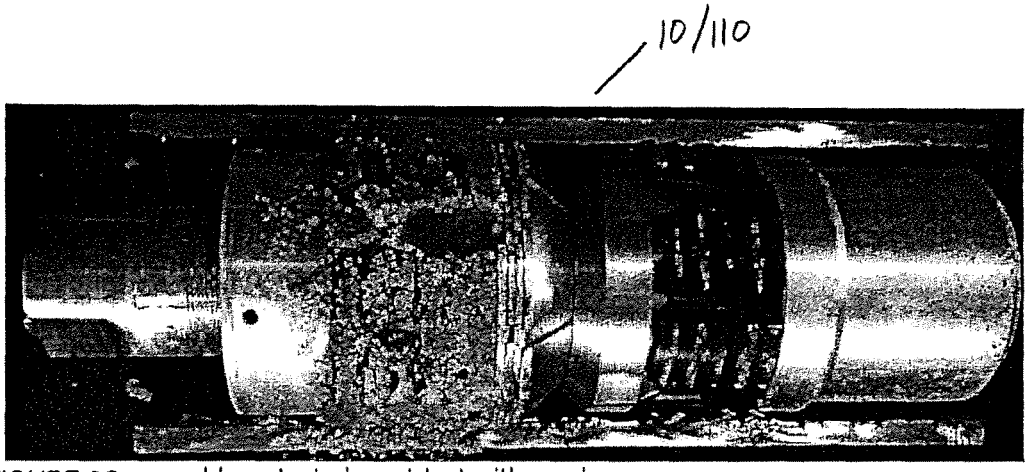
FIGURE 3G: assembly as tested, post-test with sand
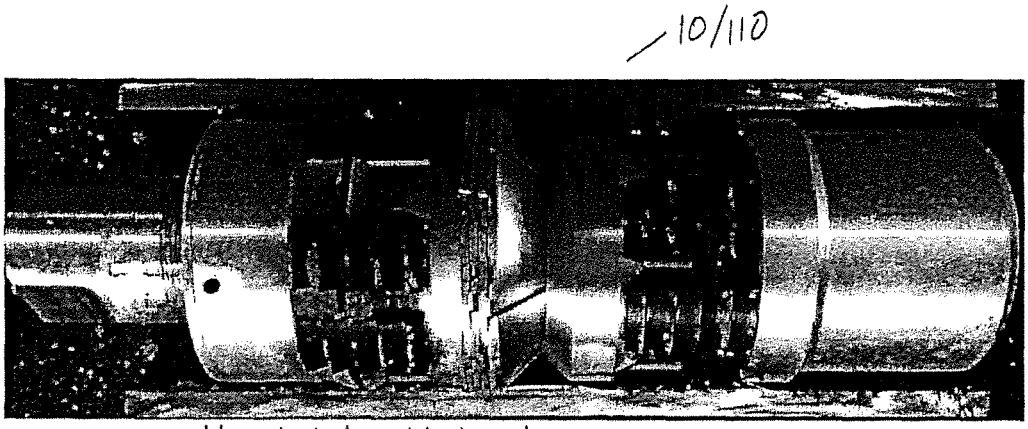
FIGURE 3H: assembly as tested, post-test sand

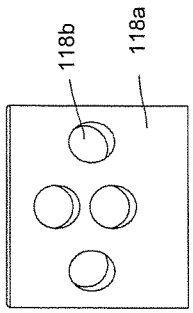
Fig. 4E3
VIEW C-C
4 PLACES
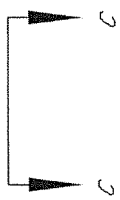
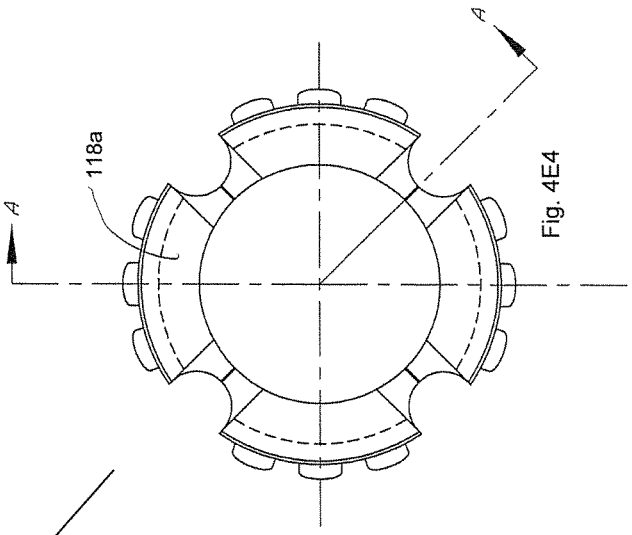
Fig. 4E4
118
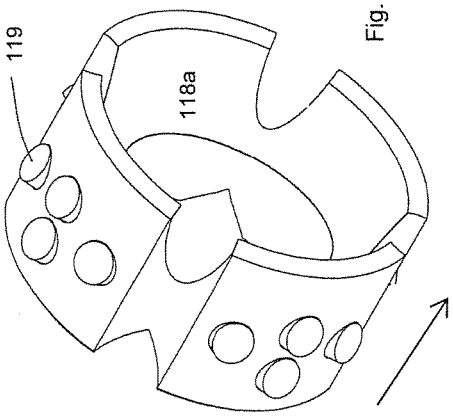
Fig. 4E1
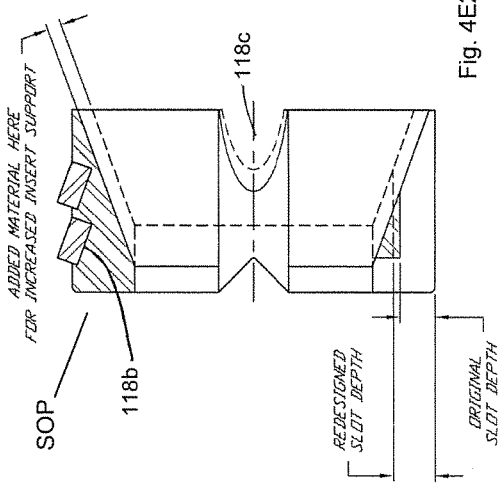
Fig. 4E2
SECTION A-A
MADE SLOTS DEEPER TO
COMPENSATE FOR INCREASED
INSERT SUPPORT MATERIAL
IN ORDER TO MAINTAIN
SLIP BREAKAGE LOAD ALL ALUMINUM PLUG W/DEGRADEABLE
SEALING ELEMENTS - INTERVENTIONLESS
NO MILLING OR RETRIEVAL REQUIRED.
DEGRADEABLE SEALING ELEMENT

DEGRADEABLE SEALING ELEMENT

BRIDGE PLUG/FLO-BACK/FLO-CHECK
KIT INTERCHANGEABILITY

DISSOLVABLE ALUMINUM DOWNHOLE PLUG

This is a utility application, claiming the benefit of, priority to, and incorporating by reference all of the following U.S. Provisional patent applications: Application No. 61/974,065 filed Apr. 2, 2014, Application No. 62/003,616 filed May 28, 2014, and Application No. 62/019,679 filed Jul. 1, 2014.

FIELD OF THE INVENTION

Downhole plugs for use in oil and gas well completion, and methods of using them.

BACKGROUND OF THE INVENTION

Downhole plugs, including bridge plugs, packers, cement retainers, and other plugs with dissolvable elements, may be set and used downhole and adapted to dissolve in natural downhole fluids or in introduced downhole fluids.

SUMMARY OF THE INVENTION

Downhole plugs for use in oil and gas well completion, and methods of using them are disclosed. A substantially all aluminum downhole plug capable of, in an embodiment, dissolving in natural wellbore fluids produced from formation flow (or wellhead introduced fluids) is disclosed. A method of using an aluminum plug in completion of oil and gas wells is disclosed. The application discloses aluminum split rings for seal or pack off, a backup pump out ring, an interchangeable parts kit, a degradable elastomer seal or pack off, and other features and methods; all applicable to a substantially all-aluminum downhole tool, a downhole tool made from other materials, or use with downhole tools of otherwise conventional design. Other disclosures are stated below and described in the drawings.

A downhole tool for use in a cased well, the downhole tool comprising a mandrel having a first end and a second end, an exterior and an interior, the interior having an interior diameter; a top ring for engaging the first end of the mandrel at the exterior thereof; a bottom subassembly for engaging the second end of the mandrel at the exterior thereof; an upper and lower slip for locating adjacent the exterior of the mandrel between the first and second ends thereof, the slips having a slip body with multiple inserts located on an exterior surface of the slip body; a sealing element located adjacent the exterior surface of the mandrel between the slips; a first wedge and a second wedge located longitudinally adjacent the sealing element on either side thereof, the first wedge engaging the first slip and the second wedge engaging the second slip, wherein at least one or more of the following group is made of aluminum that will dissolve in downhole fluids: at least one of the slips, the mandrel, at least one of the wedges, the top ring, the bottom subassembly, wherein the slip is comprised of an aluminum body and the inserts are comprised of a material harder than the aluminum body, wherein the inserts are cast iron, wherein the mandrel is aluminum and the I.D. is between about 1.75 and 2.50 inches at its narrowest point; further including a pump-out ring assembly having a pump-out ring assembly having a pump-out ring with a ball seat, a ball, and a keeper for engaging the lower end of the tool so as to seal the mandrel interior of the tool when hydrostatic pressure is applied from above, and to shear the engagement with the lower end of the tool when hydrostatic pressure exceeds a preset minimum, wherein the pump-out ring engages the bottom subassembly through multiple set screws providing adjustable an pump-out pressure; further including an upper captured ball assembly comprising an upper ball, a setting tool adapter to engage the first end of the mandrel, the first end of the mandrel being dimensioned to include an upper ball seat, wherein the upper ball is dimensioned to be located between the upper ball seat of the mandrel and the setting tool adapter.

The downhole tool further includes a free ball; and a pump-out ring assembly having a pump-out ring with a ball seat, a ball, and a keeper for engaging the lower end of the tool so as to seal the mandrel interior of the tool when hydrostatic pressure is applied from above, and to shear the engagement with the lower end of the tool when hydrostatic pressure exceeds a preset minimum, wherein the first end of the mandrel is dimensioned to include an upper ball seat, the upper ball seat located above the pump-out ring assembly and the upper ball seat dimensioned to receive the free ball after the tool is set and the pump-out ring is pumped out, wherein the sealing element is dissolvable in downhole fluids, wherein the sealing element is a split ring assembly and is dissolvable in downhole fluids, wherein the split ring assembly is aluminum, wherein the sealing element is a degradable elastomer which will dissolve in downhole fluids, wherein the sealing elements are multiple split rings having a gap cut through from an outer perimeter thereof through an inner perimeter thereof, wherein the sealing elements are multiple split rings having a gap cut only part way through from an outer perimeter thereof to an inner perimeter thereof, wherein the sealing elements are multiple split rings having a groove extending at least part way between an outer perimeter and an inner perimeter.

A kit for providing multiple settable downhole tool uses on a common subassembly, the tool adapted to seal against the inner wall of a casing, the subassembly comprising a mandrel having a first end and second end, an exterior surface, and an interior surface including a ball seat, a pair of slips, a pair of wedges, and sealing elements entrained on the outer surface of the mandrel, the kit including two or more of following: a top ring dimensioned to engage the first end of the mandrel; a bottom sub for engaging the second end of the mandrel; a flow back insert; a kill plug for engaging the interior surface of the mandrel and plugging the same; a pump-out ring assembly including a pump-out ring having a pump-out ring ball seat, the pump-out ring for engaging the lower end of the interior surface of the mandrel, a keeper pin and a pump-out ring ball; and a top ball for engaging the ball seat on the inner surface of the mandrel.

A settable plug for use in oil and gas well casing capable of blocking fluid flow through a well's borehole, and comprising: a mandrel having an inner bore and an exterior surface; a bottom subassembly for engaging the mandrel; a pump-out ring with a ball seat thereon for engaging the lower end of the mandrel and the bottom subassembly; slips for engaging the exterior surface of the mandrel, the slips including inserts; wedges for engaging the slips and the exterior of the mandrel; an expandable element for engaging the mandrel and the wedges; and a top ring, wherein one or more of the foregoing elements, except the inserts, is made of non-composite, non-sintered aluminum or aluminum alloy, and the plug is capable of being dissolved in the wellbore fluid having a pH less than about 7 so within about two days of the plug being inserted into the wellbore fluid, the plug no longer blocks wellbore fluid communication.

A downhole tool for use in a cased well having a casing with a casing internal diameter, the downhole tool comprising: a cylindrical mandrel having a first end and a second end, an exterior and an interior, the interior having an interior diameter; a top member for engaging the mandrel near the first end; a bottom member for engaging the mandrel near the second end; an upper and a lower slip for locating adjacent the exterior of the mandrel between the first and second ends thereof and slidable with respect to the mandrel between a preset and a post-set position; a first wedge and a second wedge, the wedges located on the mandrel and slidable with respect to the mandrel between a preset and a post-set position; and a sealing element located adjacent the exterior surface of the mandrel and directly contacting both the first and the second wedges, the first and second wedges having walls facing and contacting the sealing element, the sealing element comprising at least one ring having an outer perimeter and an inner perimeter, the ring having a pre-set configuration and a post set configuration, wherein in the post set configuration, the outer perimeter has a greater diameter than in the preset configuration, and wherein the post set configuration has one or more gaps in the ring and the outer perimeter contacts the inner wall of the casing, wherein the wedges engage the slips and the sealing element such that axial movement of the wedges will cause the ring of the sealing element to expand to the post set position, wherein the ring is substantially metallic, wherein the ring is dissolvable aluminum, wherein the ring is at least partly dissolvable in downhole fluids so as to release its seal against the inner wall of the casing within at least two hours to about two days after contact with downhole fluids, wherein the preset configuration of the ring includes one or more gaps, wherein the gap or gaps begin in the outer perimeter and extend, preset, only part way to the inner perimeter, wherein the ring has a frusto-conical shape, wherein the rings are two or more, nested in preset configuration, with the gap or gaps of one staggered with respect to the other, wherein the gap or gaps begin in the outer perimeter and extends all the way through to the inner perimeter, wherein the ring has a cylindrical shape, wherein the gap or gaps pre-set extend all the way through from the outer perimeter to the inner perimeter and wherein there is only one gap in the preset configuration, wherein the rings are multiple and aligned adjacent one another along the mandrel, wherein the adjacent rings of the multiple rings engage one another through a tongue and groove engagement structure, wherein the ring is frangible, having a groove or grooves in the preset configuration, the groove or grooves extending from at least partly, the outer perimeter to the inner perimeter, wherein the rings are multiple adjacent rings. The rings are multiple rings with an antiseize agent between adjacent contacting surfaces.

An interventionless method of treating a downhole formation comprising the steps of positioning a substantially aluminum dissolvable temporary plug in a well casing; setting the plug; completing a well operation, up hole of the plug; contacting the plug with an acidic wellbore fluid, wherein the plug is substantially dissolved without milling and substantially produced up the casing over a period of time, wherein the plug has one or more of the following elements made of aluminum: a mandrel, a slip, a cone, a top ring or a bottom subassembly, wherein two or more of the elements are aluminum alloys having differing electroactivity, wherein the wellbore fluid is produced oil or gas, wherein the well operation is conducted with a well operation fluid, and the wellbore fluid is the well operation fluid flow back, wherein the well operation fluid is substantially water or CO2, wherein the wellbore fluid has a pH less than about 7, wherein the wellbore fluid has a pH of between about 5 and about 4; further comprising circulating a non-acidic/basic fluid though the plug during the positioning and the setting to reduce early dissolving of the plug; further comprising subsequently performing an acidizing operation on the well to fully dissolve the plug, wherein the well operation is completed within about 36 hours, wherein the period of time for the plug to substantially dissolve is between about 2 days and about 60 days, wherein the well operation is a fracturing operation or a perforating operation, wherein the plug has an aluminum slip body with inserts made of a harder material than the aluminum of the slip body, wherein the substantially aluminum plug includes dissolvable aluminum split ring assembly, but no elastomer.

A method of treating a downhole formation comprising positioning a temporary plug in a well casing, the plug having a mandrel, slips, cones and a split ring sealing assembly but no elastomer sealing element; setting the plug to activate the slips and urge the sealing assembly and the slips against the well casing; completing a well operation, up hole of the plug; and contacting the plug with an acidic wellbore fluid, wherein the plug sealing assembly is substantially dissolved over a period of time, wherein the wellbore fluid is produced oil or gas, wherein the well operation is conducted with a well operation fluid, and the wellbore fluid is the well operation fluid flow back, wherein the well operation fluid is substantially water or CO2, wherein the wellbore fluid has a pH less than about 7, wherein the wellbore fluid has a pH of between about 5 and about 4; further comprising circulating a non-acidic/basic fluid though the plug during the positioning and the setting to reduce early dissolving of the sealing assembly; further comprising subsequently performing an acidizing operation on the well to fully dissolve the sealing assembly; the well operation completed within about 36 hours; the period of time is for substantial dissolution of the sealing assembly about 2 days and about 60 days, wherein the well operation is a fracturing operation or a perforating operation, wherein the split ring sealing assembly comprises a plurality of nested, frustoconical rings having a plurality of vanes extending from a base, wherein setting the plug urges the vanes radially outward to form a seal between the plug and the casing, wherein the well operation includes the introduction of a fluid containing multiple plugging particles, which may be sand particles into the well after the plug has been set, wherein the split ring sealing assembly comprises at least one expandable c-ring shaped ring, wherein setting the plug urges the expandable c-ring shaped rings elements radially outward to form a seal between the plug and the casing, wherein the well operation includes the introduction of a fluid containing multiple sand particles or other proppants into the well after the plug has been set, wherein the split ring sealing assembly comprises a plurality of rings having an outer and an inner diameter, with at least one weaking groove extending between the inner and outer diameters, wherein setting the plug urges the rings against the casing and splits the rings at the groove, wherein the well operation includes the introduction of a fluid containing multiple sand particles or other proppants into the well after the plug has been set, wherein the well operation is a fracturing operation conducted with a frac fluid containing proppants, wherein setting the plug causes the split ring sealing assembly to form a partial seal, and subsequently the proppants pack off the partial seal to form a substantially fluid-tight seal with the well casing, wherein the split ring sealing assembly subsequent to the formation of the substantially fluid tight seal dissolves sufficiently that the plug is no longer sealed to the casing, wherein the split ring sealing assembly of the temporary plug of the position step is comprised of materials that are galvanically more active than other elements of the temporary plug.

A method of treating a downhole formation comprising positioning a downhole tool in a well casing, the downhole tool having metal sealing element for use in a cased well having a casing with a casing internal diameter, the downhole tool comprising a cylindrical mandrel having a first end and a second end, an exterior and an interior, the interior having an interior diameter; a top member for engaging the mandrel near the first end; a bottom member for engaging the mandrel near the second end; an upper and a lower slip for locating adjacent the exterior of the mandrel between the first and second ends thereof and slidable with respect to the mandrel between a preset and a post-set position; a first wedge and a second wedge, the wedges located on the mandrel and slidable with respect to the mandrel between a preset and a post-set position; a sealing element located adjacent the exterior surface of the mandrel and directly contacting both the first and the second wedges, the first and second wedges having walls facing and contacting the sealing element, the sealing element comprising at least one ring having an outer perimeter and an inner perimeter, the ring having a pre-set configuration and a post set configuration, wherein in the post set configuration, the outer perimeter has a greater diameter than in the preset configuration, and wherein the post set configuration has one or more gaps in the ring and the outer perimeter contacts the inner wall of the casing, wherein the wedges engage the slips and the sealing element such that axial movement of the wedges will cause the ring of the sealing element to expand to the post set position, setting the downhole tool to activate the slips and urge the sealing element and the slips against the well casing; and completing a well operation, uphole of the downhole tool, wherein the well operation is a fracturing operation conducted with a frac fluid containing particles, wherein activating the sealing element forms at least a partial seal; and subsequently the particles pack-off the at least partial seal to form a substantially fluid-tight seal; the method further comprising milling out the downhole tool after completing the well operation.

BRIEF DESCRIPTION OF THE DRAWINGS

FIG. 3E1 is a partial external side view of the plug of FIG. 3E in a set position, also showing the casing.

FIG. 3F1 shows an exploded partial cutaway view of an alternate embodiment of a split ring assembly.

FIG. 3F2 shows a partial cutaway side view of a set tool would look if it were set without casing, showing how the O.D. of the expanded split rings may be such that they engage the I.D. of the casing, in one embodiment.

FIGS. 4E1-4E4 are views of an aluminum slip for use with a downhole tool.

DETAILED DESCRIPTION OF THE PREFERRED EMBODIMENTS

Figure 1:
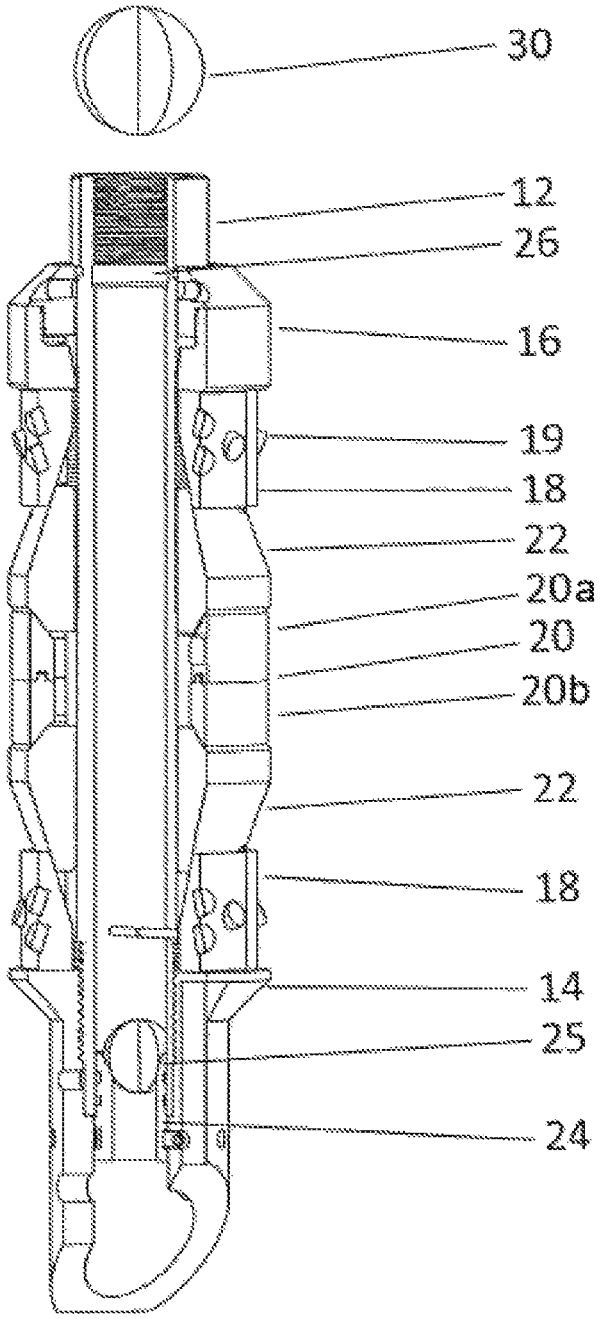
FIG. 1 is a partial external perspective view and a partial cutaway view of an embodiment of an aluminum plug showing a drop ball, split rings, and a pump out ring.
Figure 1A:
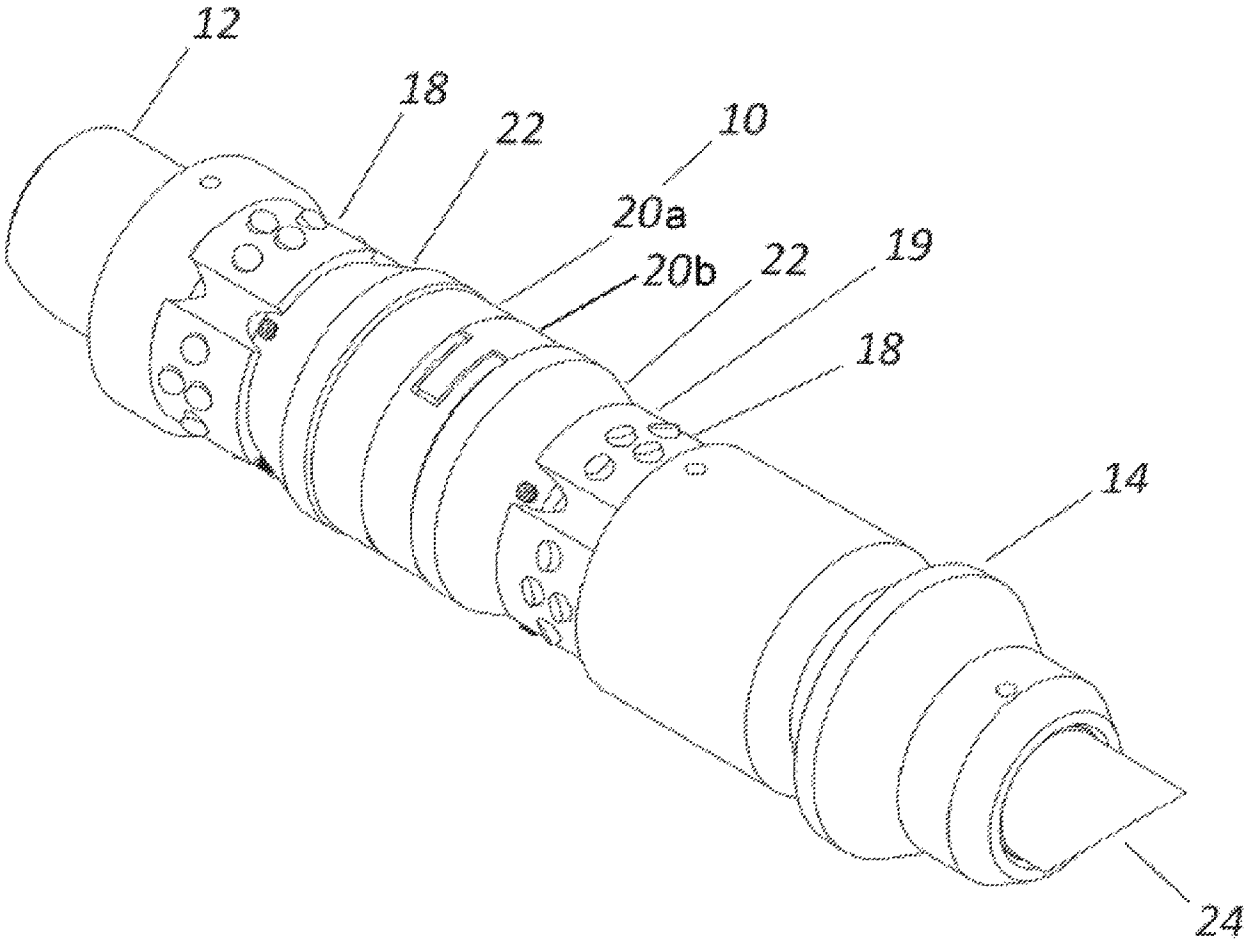
FIG. 1A is an external perspective view of an embodiment of an aluminum plug showing a ball and split rings.

An interventionless plug for isolating a wellbore is provided. The term "plug" refers to any tool used to permanently or temporarily isolate one wellbore zone from another, including any tool with blind passages or plugged mandrels, as well as open passages extending completely there through and passages blocked with a check valve. Such tools are commonly referred to in the art as "bridge plugs," "frac plugs," and/or "packers." Such tools can be a single assembly (i.e., one plug) or comprise two or more assemblies (i.e., two or more plugs) disposed within a work string or otherwise connected and run into a wellbore on a wireline, slickline, production tubing, coiled tubing or any technique known or yet to be discovered in the art.

Plugs are "interventionless" if they do not require milling out or retrieval to sufficiently remove them from the well so completion can continue, but rather may be left in the well where they disintegrate or dissolve to the same effect. Using interventionless downhole plugs saves time and expense in well completion and work over processes, including fracing and/or acid completions.

A) A Substantially "All Aluminum" Plug

A dissolvable aluminum plug capable of functioning as a packer, cement retainer, bridge plug, or other fluid block in a borehole, and then dissolving in the borehole, is disclosed in FIGS. 1, 1A, 2, 3, 3E, 3E1, 3F, 4, 4C, 4D, 5, 6A, 8A-D, 9A, 9B, 10A-E, 11A-B, and 12A-B. It is noted that the foregoing also disclose various novel features other than all-aluminum components. These other novel features are novel with respect to any material including prior art materials. Incorporated by reference are U.S. Pat. No. 8,899,317.

The disclosed plug dissolves in conjunction with natural wellbore fluid, or operator added fluid, namely an aluminum dissolving or melting medium. In one embodiment, natural wellbore fluids produced from the formation flow through the plug's aluminum mandrel and about its other aluminum parts and, over a predetermined duration of time, dependent on plug composition, fluid composition, temperature, pH and the like, substantially dissolve the plug's mandrel and other aluminum parts. As the mandrel and other parts dissolve, fluid reaches the remainder of the plug and begins to dissolve the remainder of the plug. The plug dissolves substantially completely. "Dissolve" as used herein means for a unit to dissolve, oxidize, reduce, deteriorate, go into solution, or otherwise lose sufficient mass and structural integrity due to being in contact with fluid from or in the well that the dissolved unit ceases to obstruct the wellbore. This removes the necessity for drilling out or removing the plug from the well so completion can continue.

In one preferred embodiment, balancing the cost of rig time on site while waiting for the plug to dissolve against the cost of milling out the plug without delay, the practical period of time for the plug to dissolve is between a few hours and two days. If, for a particular well, additional well completion work below the plug is unnecessary for an extended period of time, then the time for dissolution of the plug which is practical for that well may be increase to that extended period of time ranging from about three to five days to about three months. A useful wellbore fluid is preferably acidic, having a pH less than 7 pH. Greater acidity speeds dissolution of the disclosed plugs. A more preferable has a pH less than 5, or a range of pH from about 4-5. The preferable duration for the plug to dissolve in the well is determined before choosing to use the plug in the well and is used in choosing which dissolvable plug with which structures and materials to employ. In one embodiment, it is about two to three hours to about two to five days from setting, or up to three to five weeks. After the plug is placed in the well and used, the next step of well completion is delayed until expiration of the determined duration for plug dissolution, that is, the time between immersing the plug in the wellbore fluid and the plug's ceasing to prevent the next step of well completion due to the plug dissolving. Alternatively, if operator added fluid is used to cause or accelerate plug dissolution, the next step of well completion is delayed until expiration of the determined duration for plug duration after the operator added fluid is added.

A method of using the plug is to determine the well's fluid composition, temperature and pH, and the time until the next well completion step, decide if these make the disclosed plug dissolvable in the well in a practical period of time, and, if so, an appropriate such plug in the well, assemble and use such a plug in the well, and delay the next step of well completion until the plug has sufficiently dissolved.

The disclosed embodiments can be used as described herein or in otherwise conventional plugs. For clarity, in describing the instant embodiments, some elements, such as mandrel 12/112 are identified by two different element numbers, such as by placing "1", "2" or "3" before the element's identifying two digit number. This conveys that in some cases the same element can be used with either conventional tools, such as elastomer bearing tools, or with the embodiments as disclosed herein. For example, mandrel 12/112/312 in seen in at least three different tools described herein.

Figure 4:
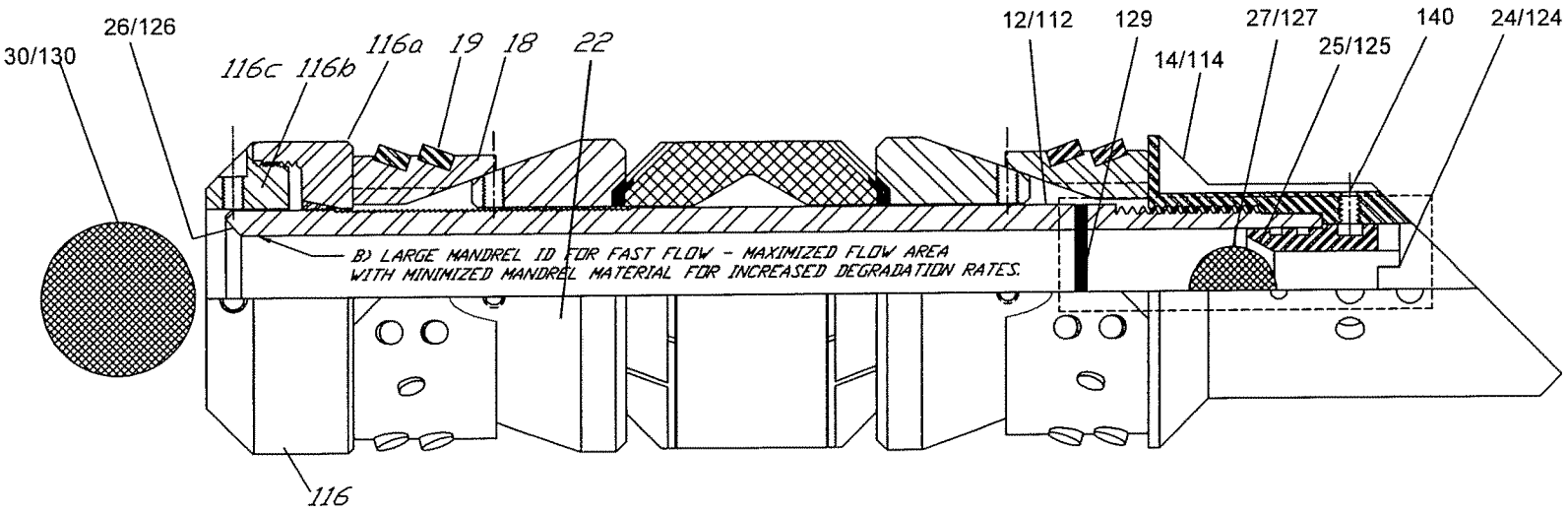
FIGS. 4, 4A (ball drop details) and 4B (pump-out ring details) and 5 are cross-sectional, exploded and detailed views of an alternative plug embodiment with different elements, including a dissolvable elastomeric pack off as sealing element instead of split rings.
Figure 4A:
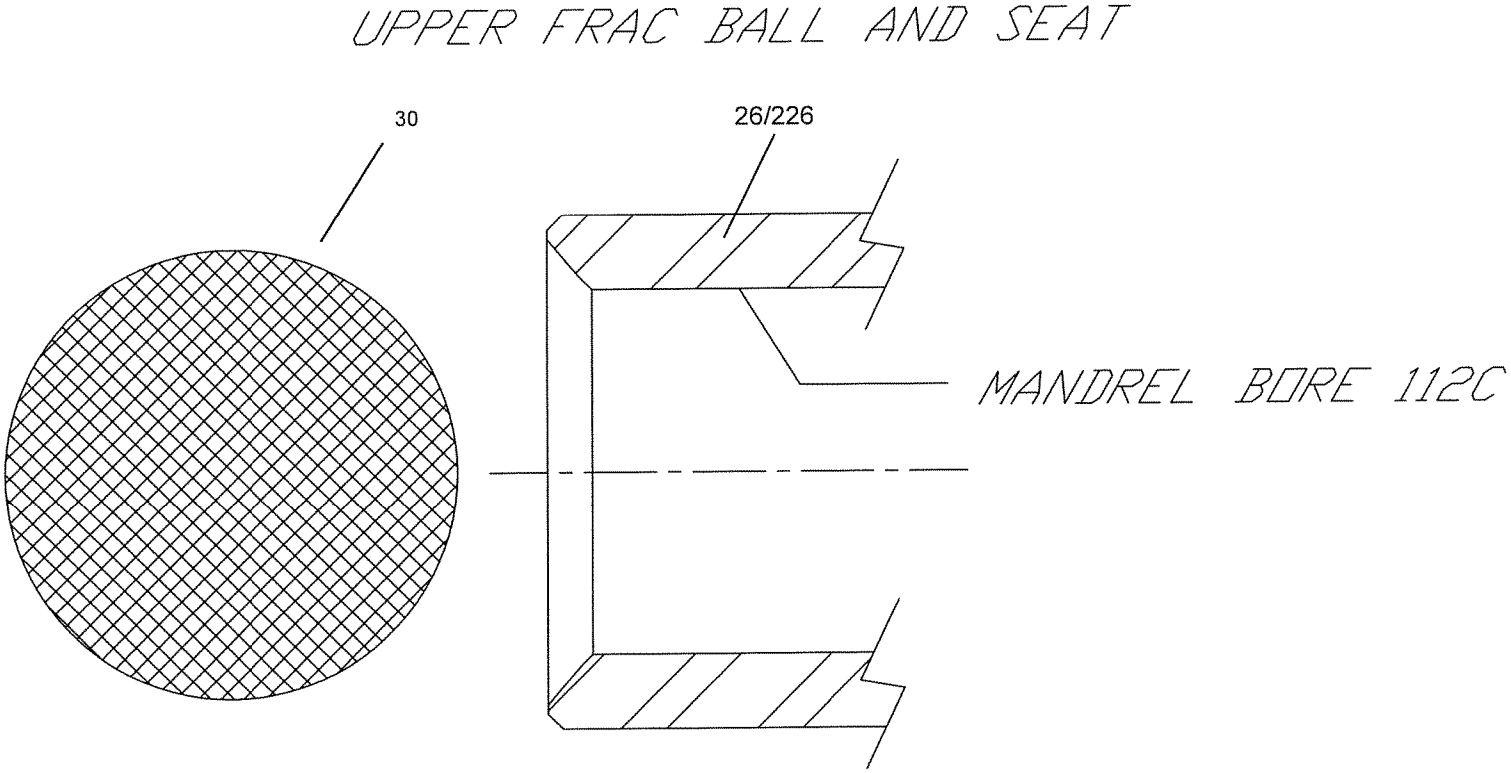
Figure 4B:
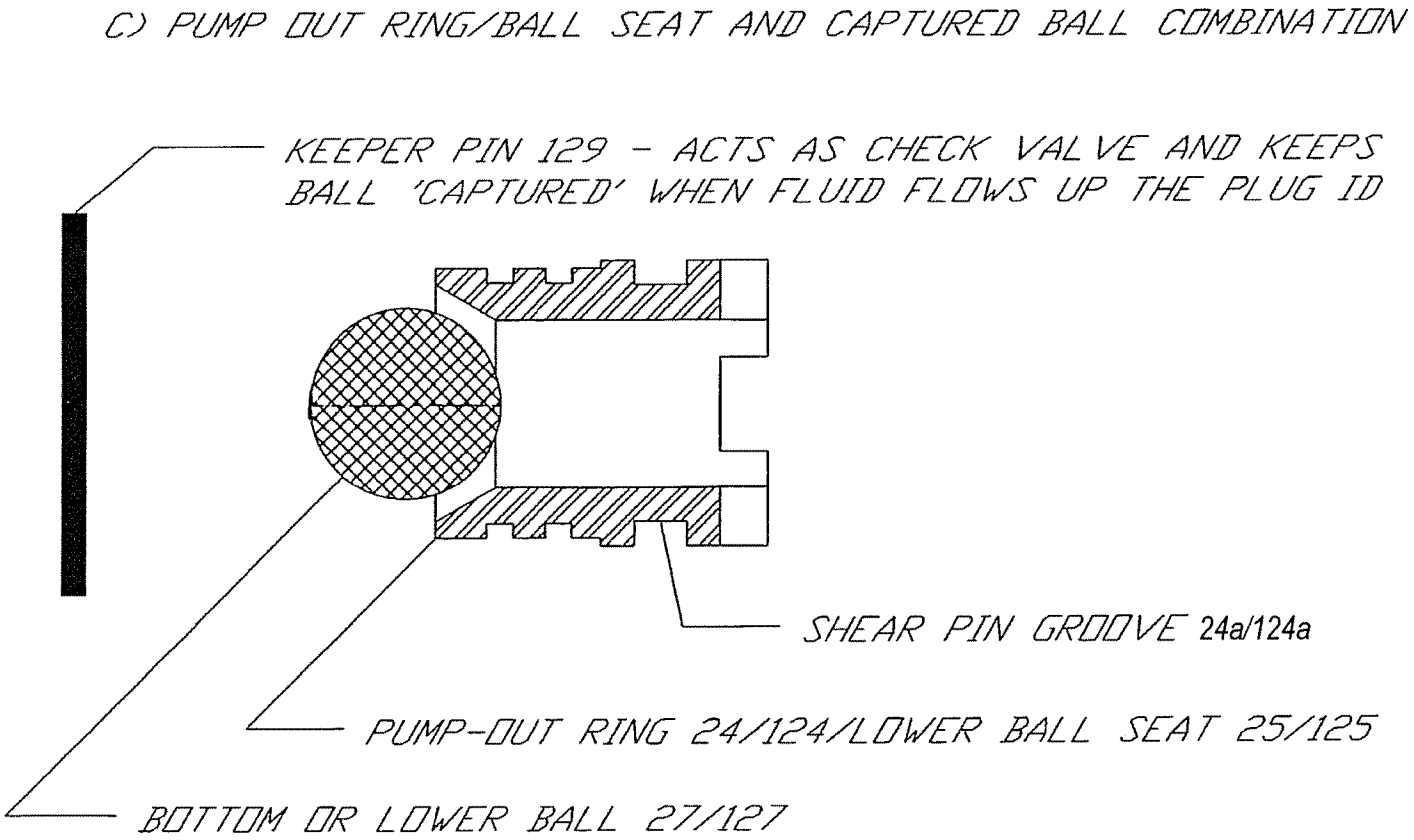
Figure 4C:
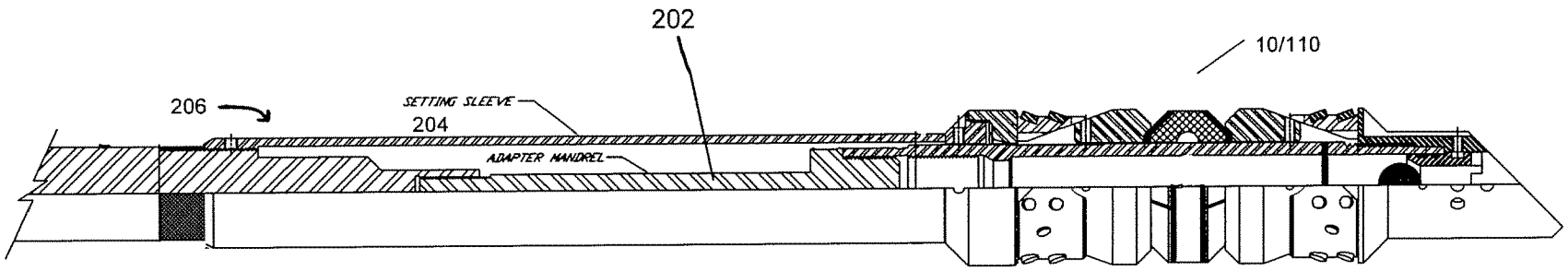
FIGS. 4C and 4D are partial cut away side views of a plug embodiment with an adapter mandrel and setting sleeve.

FIGS. 1-3 and 4-6A illustrate a plug 10/110 for use in a downhole casing, such as during completion of an oil and gas well. Plug 10/110, in one embodiment, has multiple aluminum elements capable of dissolving in downhole fluids. Plug 10/110 may include at least an aluminum mandrel 12/112 having a near end 12*a*/112*a* and a removed end 12*b*/112*b*, and an open cylindrical bore or interior 12*c*/112*c*. In one embodiment, upper ball seat 26/126 may be configured as part of the interior surface of mandrel 12/112 for receipt of secondary ball 30/130. For example, if the first gun misfires, secondary ball 30/130 may be dropped in the casing with a second perf gun and seal against plug 10/110's upper ball seat, for sealing the well against down flow or flow through from left to right of fluid within the mandrel. As seen in FIG. 4C, the mandrel may be threaded for receipt of a setting tool 206, and upper assembly 16/116 may be threadably engaged to the upper end of the mandrel 12/112 to function in ways known in the art.

A split lock ring ratcheting system 117 (see FIG. 4) may be received against the exterior of the mandrel 12/112 to prevent the upper assembly or top ring 116 from moving up along the mandrel. The lock ring inner threads engage the threads on the mandrel outer surface to prevent backward movement when force from the setting tool is released. This locking action maintains compressive pressure on the setting elements, such as slips and packing elements. This preserves the plug's lock against the casing and seal with the casing by keeping the slips and sealing elements, such as elastomers or split rings, locked and pressed against the inner diameter of the casing.

In one embodiment, upper assembly 16/116 is comprised of load ring 16*a*/116*a* (outer) and top ring 16*b*/116*b*, the two parts threaded together, with set screw 116*c* (see FIG. 4) to help hold the upper assembly onto the exterior of the mandrel. Split lock ring ratcheting assembly 117 has one-way teeth as shown in FIG. 4, allowing it to slide one way against cooperating teeth on the exterior of the mandrel. As split ring ratcheting assembly 117 is split when compression is urged between the top ring and the bottom wedge assembly (as when setting), the split ring is pushed from left to right in FIG. 4, allowing aluminum slips 118 to be forced radially outwards by aluminum cone or wedge elements 122 (See also FIG. 4E). The "one way" teeth prevent the lock ring from moving right to left on the mandrel (as seen in FIG. 4).

Mandrel 12/112 may be dimensioned and function in ways known in the art or in the novel ways described herein. Likewise, upper assembly 16/116, bottom sub 14/114, slips 18/118, wedge, or cones 22/122 operate generally in ways known in the art, for example, to set a tool, but have novel properties and characteristics described herein.

The sealing element in conventional bridge plugs is an elastomeric seal comprised of a rubber or a rubber-like elastomer. Milling out plugs which have rubber or rubber-like polymer seals sometimes creates problems when the milling head encounters the rubber seal. Rubber seals sometimes tend to gum up the milling head and leave gummy debris in the hole, back of which can create problems during completion operations. Embodiments are disclosed herein in which the sealing element does not have to be drilled out, but rather degrades together with the plug generally in the presence of production fluids or fluids added from the wellhead. Alternative sealing element embodiments are disclosed in more detail below, one alternative embodiment being the split ring assembly 20.

In one embodiment, aluminum, polyglycolic acid or other suitable dissolving material is used to comprise a free or dropped frac ball 30, which may seat on an aluminum ball seat 26/126 within the aluminum plug. The frac ball may be comprised of materials which dissolve at a rate greater than the aluminum seat, opening the plug to fluid flow sooner than if dissolution of the seat was the limiting factor. U.S. patent application Ser. No. 14/132,608, Publication No. US2014/0190685 showing PGA or other non-aluminum degradable parts is incorporated herein by reference.

In one embodiment, all the elements of the illustrated plug, except inserts on the slips (and setting screws and shear pins), are comprised of aluminum (pure aluminum or aluminum alloy, from any of the 1000-8000 series alloys in any of the "T" hardness ranges unless otherwise specified or functionally useful aluminum admixture). In another embodiment, any one or more of the elements of the plug are aluminum, aluminum alloy or functionally useful aluminum admixture. In an embodiment, elements made of aluminum are an aluminum which is not a composite with non-metallic materials, and is not sintered or cast. It may be an aluminum alloyed with other metals, such as magnesium, silicon, copper, lithium or manganese, zinc, indium, or the like. Such alloys may increase the strength of the elements relative to unalloyed aluminum elements; or increase rate of dissolution in the wellbore relative to unalloyed aluminum. Two such aluminum alloys are 6061 T-6 and 2023 T-3.

Aluminum alloys tend to be more electronegative than steel casing. Aluminum and ferrous alloys have enhanced corrosion rates at pH 4-5. Tool elements comprised of aluminum alloys act as sacrificial anodes when in an iron casing in the presence of acidic fluids or natural downhole fluids. Galvanic corrosion of aluminum elements, including rings of the split ring assembly, is enhanced by using electrically active aluminum as a sacrificial anode in a downhole galvanic environment.

As seen in FIGS. 1, 4 and 4E, inserts 119 are provided on the slips 118 as known in the art. Slips 118 may be made of aluminum, cast iron, ceramic, composite, tungsten carbide, or any combination thereof. In one embodiment, FIG. 4E1-E4, slips 118 are comprised dissolvable of aluminum as set forth in more detail below. Inserts 119 may be cast iron or other hard suitable material.

Figure 2:
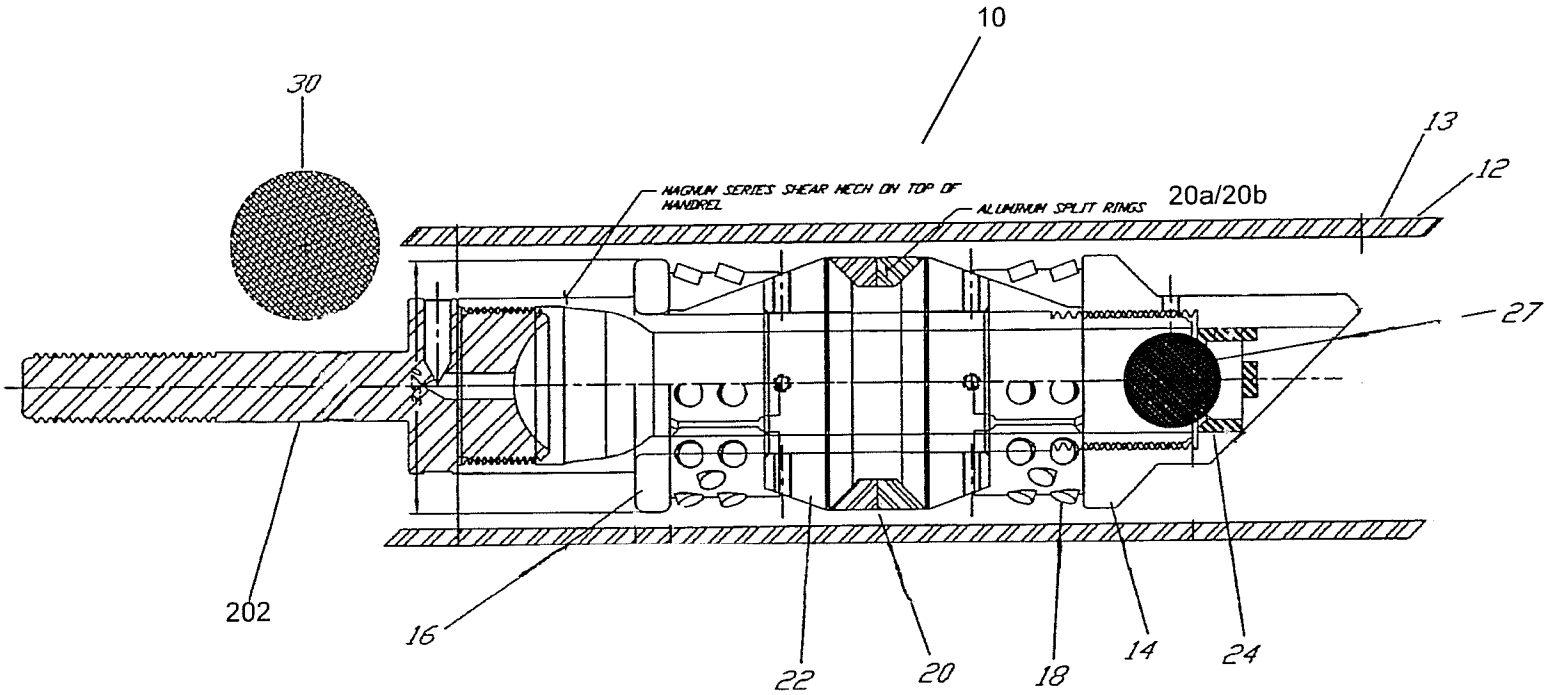
FIG. 2 is a cross-sectional view of an embodiment of a plug with a check valve and an adapter mandrel with a secondary ball.

FIGS. 4E1-4E4 illustrate a degradable aluminum slip 118 having a slip body 118*a* having button inserts 119. In one embodiment, the aluminum is degradable as described herein. In one embodiment, the aluminum is 6061 T-6. The inserts are hard, in one embodiment 40KSI grey cast iron (ASTM A48), and capable of maintaining a good "bite" on the inner walls of well hole casing when set. Slip body 118*a* may include button insert holes 118*b* dimensioned to keep the insert upper face at an acute angle with respect to the inner wall of the casing as seen in FIG. 4E2.

Figure 11A:
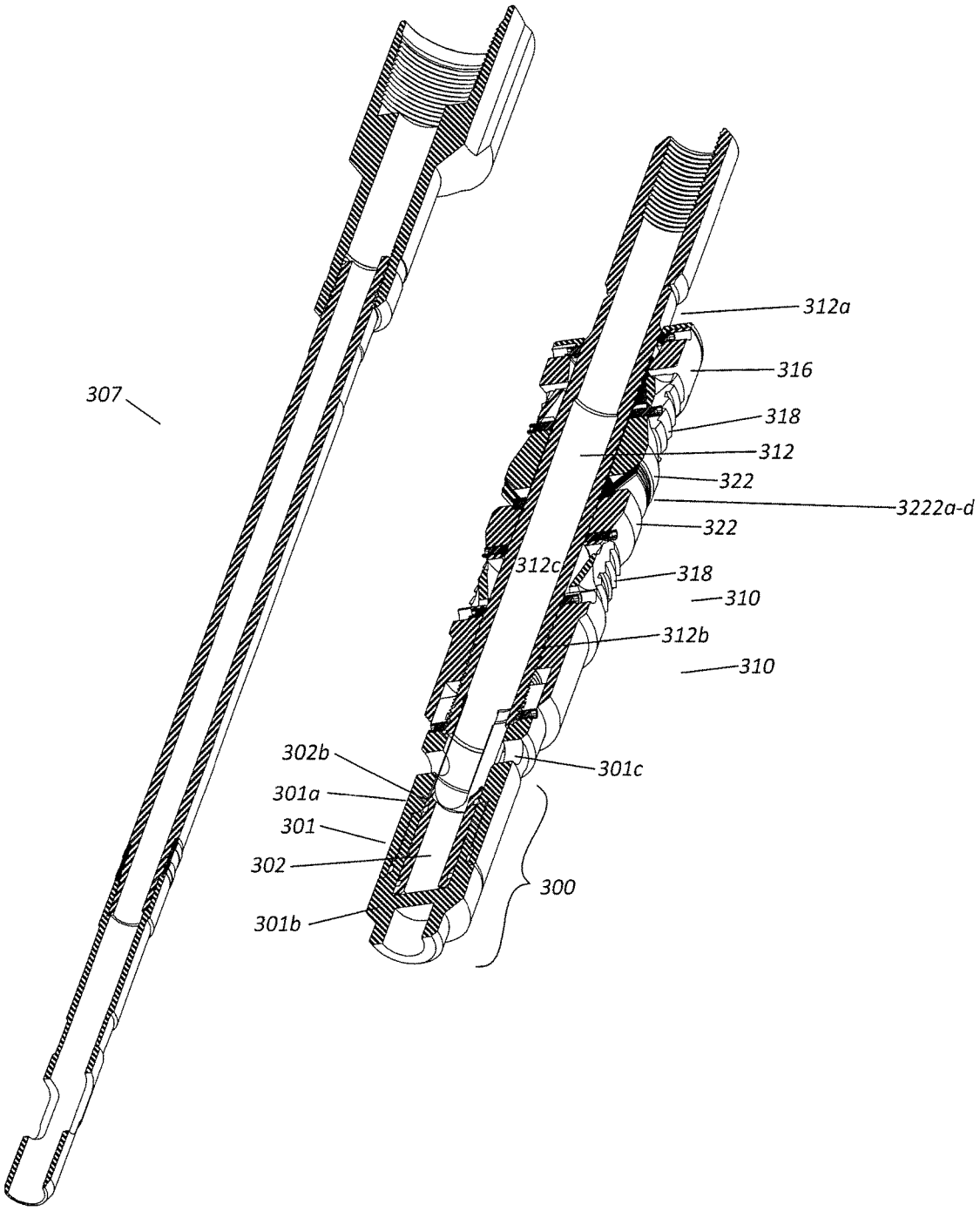
FIGS. 11A, 11B, 12A and 12B illustrate cement retainers with dissolvable aluminum elements and a split ring assembly pack off element.
Figure 11B:
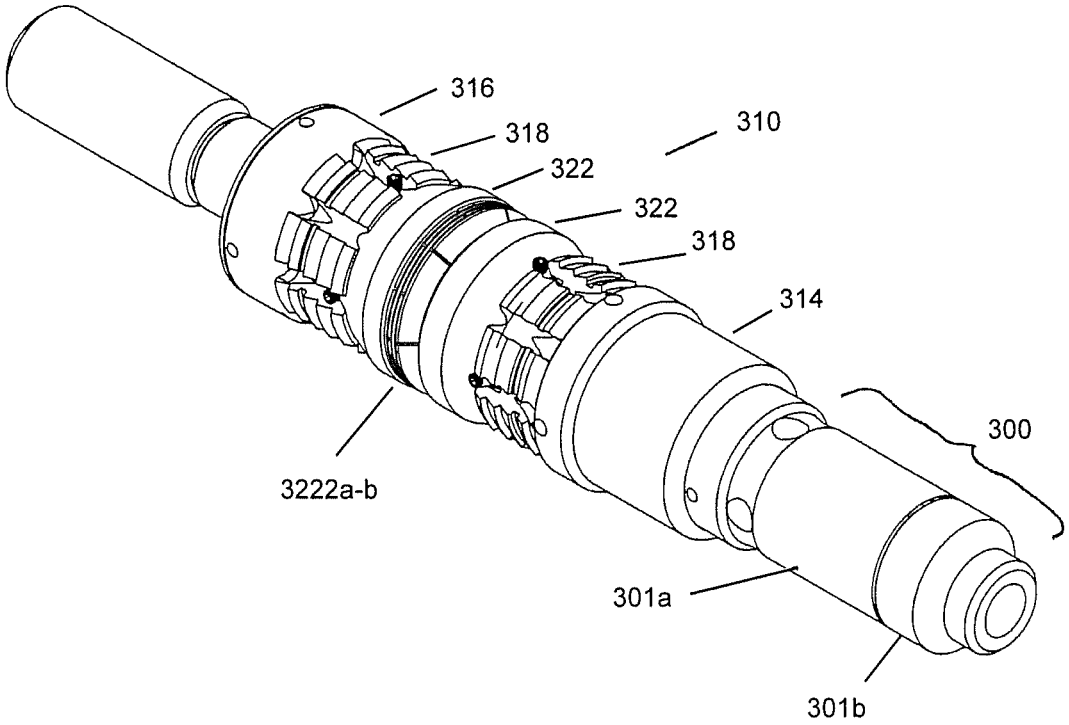
Figure 12A:
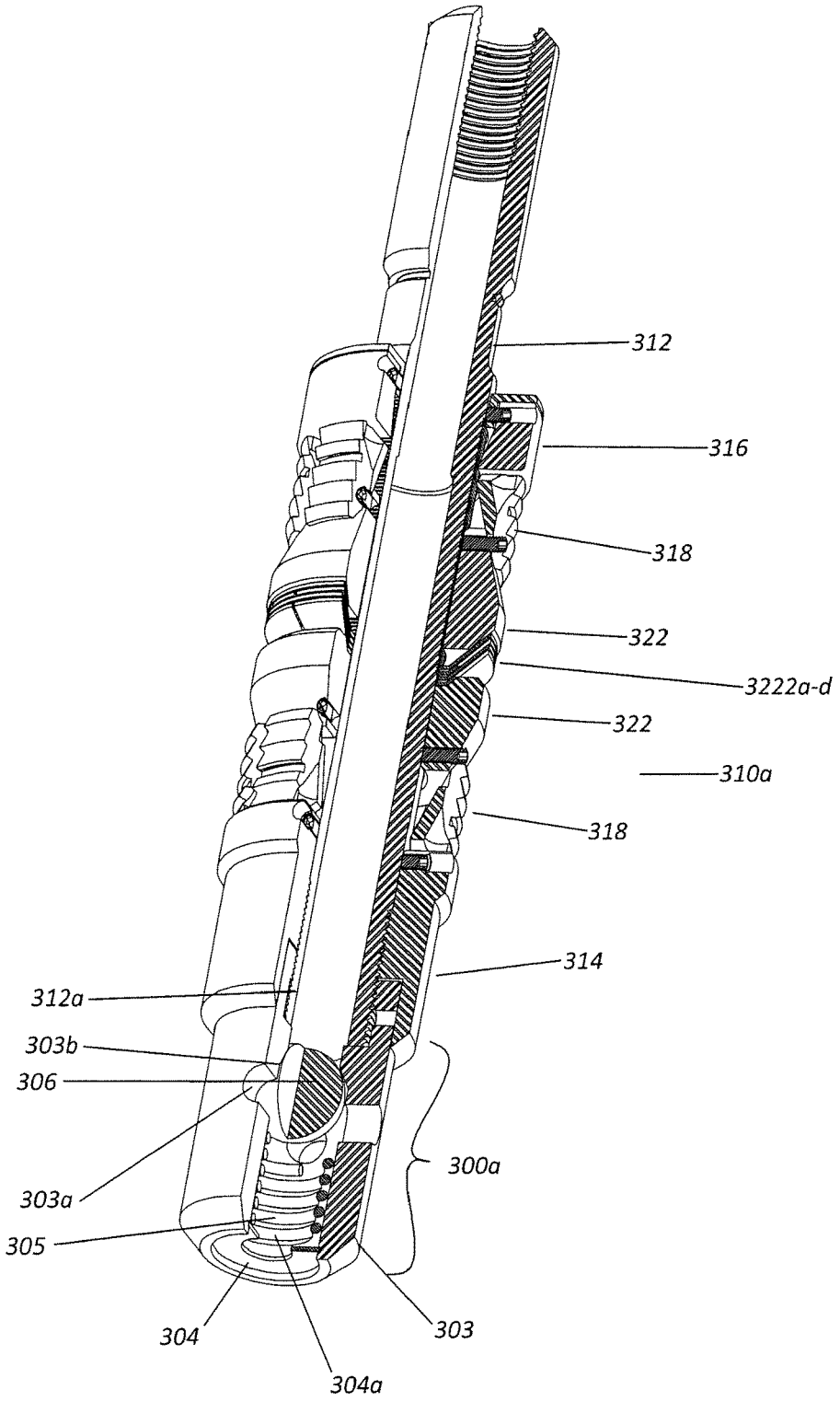
Figure 12B:
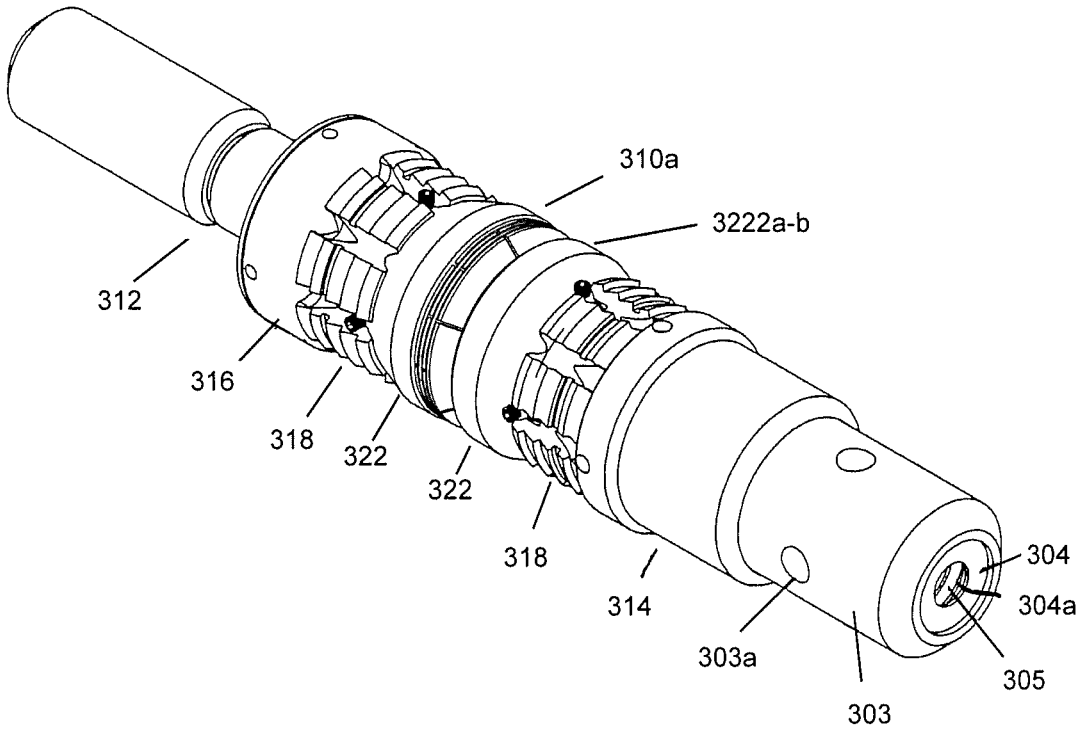

FIGS. 11A and 11B illustrate a cement retainer plug 310 having a sliding sleeve collet 300. FIGS. 12A and 12B illustrate a similar cement retainer plug 310A which employs a poppet valve assembly 300A for allowing the cement to flow from the mandrel into the casing below the tool. Both tools can best be understood with reference to the other specifications set forth herein as they have a mandrel 312 (the "3" indicating that it is structurally the same as mandrel 12 and 112, except it is part of a different tool, a cement retainer). Mandrel 312 may have a near end 312*a*, a removed end 312*b*, and a bore 312*c*. A top ring 316 may be engaged to the mandrel by set screws or in other ways known in the art. Slips 318 may engage the mandrel as set forth herein or other ways known in the art, and provide anchoring of the tool to the casing when the tool is set. Cones 322 are as known in the art or as set forth herein and functionally operate with the slips to help anchor the tool to the casing. Any number of pack off elements may be used with the aluminum cement retainers disclosed in FIGS. 11A, 11B, 12A and 12B. Pack off elements in one embodiment may be aluminum split rings as taught herein, biodegradable elastomers as taught herein or any prior art elastomer or pack off elements. In one embodiment, everything in the cement retainers is made of aluminum or aluminum alloy as set forth herein, except: elastomers (if used in place of split rings); shear screws and set screws (although both may be aluminum in optional embodiments); buttons, if used on slips; and spring 305 (typically spring steel) of the poppet valve assembly as seen in FIGS. 12A and 12B, although in an optional embodiment, it too is aluminum. Ball 306 in poppet valve assembly 300A may be aluminum or made of any other degradable elements including PGA (polyglycolic acid) or may be made of any conventional materials.

The cement retainer illustrated in FIGS. 11A and 11B may be set with a wire line. A stinger 307 may be attached to the work string and run to the retainer depth. Stinger 307 is then inserted into mandrel bore 312*c* sealing against the mandrel ID and isolating the work string from the upper annulus. Once sufficient set down weight has been applied, the stinger 307 will open the lower sliding sleeve allowing a cement squeeze (or other) operation to be performed in ways known in the art. Sliding sleeve assembly 300 provides for the introduction of cement below the tool for remedial cementing or zone abandonment, for example. In one embodiment, an acid fluid such as an HCl solution may be introduced into the well to help the solution of the aluminum elements of the cement retainer. The cement retainer can be set with wire line or coiled tubing and conventional setting tools. The slips may be cast iron in one embodiment (to be milled out) or as set forth in FIGS. 4E1 through 4E4, or conventional.

FIGS. 11A and 11B, show use of frusto conical split rings 3222*a*-*d* in a cement retainer. Sliding sleeve (collet) assembly 300 opens responsive to weighted cement introduced through stringer 307. Sliding sleeve assembly may include a two piece base 301 having threadably engaged portions 301*a* and 301*b*, having multiple holes 301*c* therein, and engageable by threading to bottom sub 314. Lower portion 301*b* of two-piece base 301 threads into upper portion 301*a* as illustrated. Sliding sleeve 302 slides between an open and closed position (open illustrated) and has a body 302*a* sealing to the inner surface of the base with O-rings. Body 302*a* has multiple arms 302*b*. Arms 302*b* slideably engage the inner surface of the mandrel and the inner surface of the base 301. When the mandrel slides to the open position illustrated, cement can move between arms 302*b* and through holes 301*c* in the base. All parts except the O-rings of the sliding sleeve assembly 300 may be made of dissolvable aluminum or aluminum alloy as described herein.

FIGS. 12A and 12B illustrate a substantially all aluminum or aluminum alloy dissolvable cement retainer 310*a* with a one-way check poppet valve assembly 300*a* rather than the collet. The cement retainer 310*a* of FIGS. 12A and 12B is otherwise similar to cement retainer in FIGS. 11A and 11B. The poppet one-way check valve assembly 300*a* is comprised of a base 303 and threadably engages removed end 312*a* of the mandrel. Base has multiple holes 303*a*. Seat 303*b* is fashioned to receive a ball 306. Spring 305 may hold ball 306 against seat 303*b*. Spring 305 is held to lower end of base 303 through the use of stop ring 304 with hole 304*a*. The poppet one-way check valve is opened by stinger assembly 307 (see FIG. 11A) and pressure from the surface. Once the cement retainer 310*a* is set, for example, on a wire line, a stinger assembly is attached. Stinger 307 is attached to the work string and run to the retainer depth. Stinger 307 is then inserted into the retainer bore and seals against the mandrel ID isolating the work string from the upper annulus. Once sufficient set down weight has been established, pressure (cement) is pumped down to the work string, opening the one-way check valve and allowing the cement to flow through holes 303*a* and into the casing below the tool.

In one embodiment, one or more of the elements of sliding sleeve assembly 310 and one or more elements of poppet valve assembly 310*a* are comprised of dissolvable aluminum/aluminum alloy, in one embodiment, 6061 T-3 or T-6. A dissolvable aluminum admixture may be used. In another embodiment, spring 305 is spring steel. Setting screws anywhere on the tool may be aluminum or non-aluminum.

Figure 13:
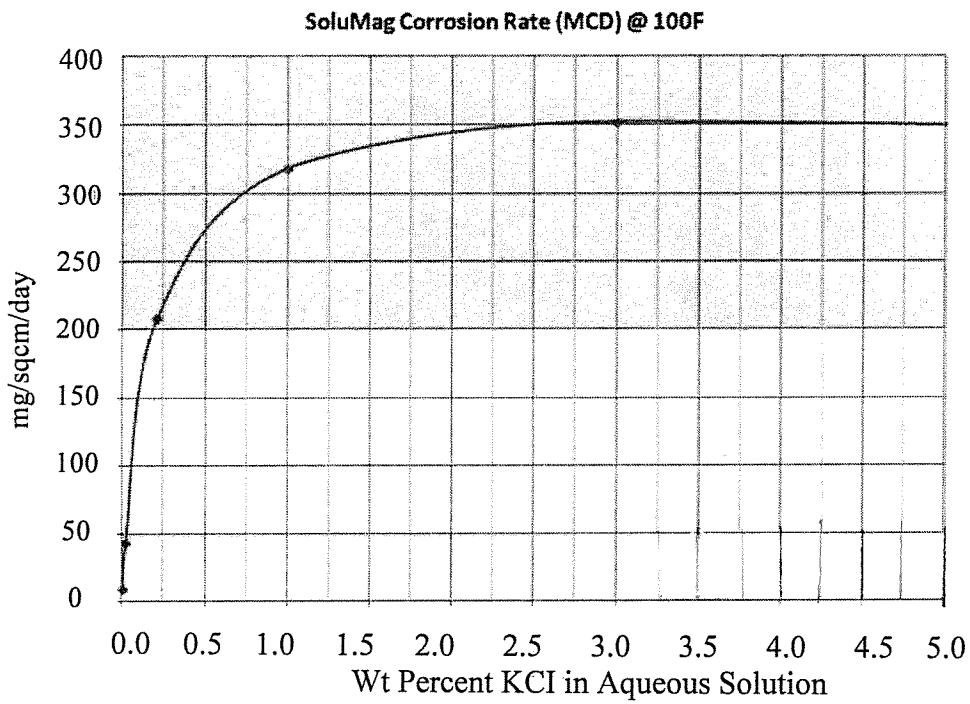
FIG. 13 is a graph showing the corrosion rate of a magnesium alloy.

A number of high strength magnesium alloys may be used in all of the applications set forth herein that call for aluminum or aluminum alloys. FIG. 13 (from Magnesium Elektron) shows the corrosion rate of one such magnesium alloy—SoluMag, available from Magnesium Elektron. This alloy is a high strength, high corrosion rate magnesium alloy developed for the oil and gas industry. It has high compressive strength and tensile strengths. This alloy, or any other suitable magnesium alloy used for one or more of the following parts about: mandrel, cones, upper assembly, lower subassembly, slips and/or split rings. This alloy may be used for tools or plugs intended for brine or KCl environments and the "all aluminum" tool for fluids with high $CO_2$ content. The rate of dissolution in FIG. 13 is given in milligrams per square centimeter per day, in a 100° F. potassium chloride, aqueous solution.

B. Large Internal Mandrel Area

The minimum cross-sectional flow area through the mandrel is, in one embodiment of a conventional or aluminum plug, in the range of about 2.50 to 5.00 square inches. In another embodiment, a bore size in the range of about 1.75 to 2.50 inches (minimum) is provided, to not inhibit the flow of wellbore fluid and enhance dissolvability. Bore size is chosen to accommodate the locally desirable and possible size, given the structure of the well and stage of completion functions, and desirable and possible fluid flow through the plug. Greater fluid flow through the disclosed aluminum plug due to these mandrel dimensions helps the plug dissolve more quickly than would a similar plug with conventional mandrel dimensions. Increasing flow of formation fluid through the aluminum plug due to the disclosed larger mandrel bores helps dissolve the plug more quickly than a similar plug with conventional mandrel dimensions. Increased temperature (compared to ground level) and increased acidity of formation fluid relative to drilling fluid passing through the bore of the mandrel speeds the dissolving process and hastens disintegration of the plug.

C) Pump Out Ring/Ball Seat, Ball Drop and Captured Ball Combinations

FIGS. 1, 2, 4, 4A, 4C, 4D, 5, 6, 6A, 8C and 8D, disclose a bridge plug, cement retainer, frac plug or packer comprised of all aluminum, aluminum alloy, aluminum admixture or conventional materials. A pump-out ring assembly is disclosed having a lower frac ball 127 pinned in place to allow the "captured" frac ball 127 to act as a check valve to allow relative fluid flow "up" through the plug. When sufficient hydrostatic pressure is applied from above the plug, frac ball 27/127 moves down, seating and checking "downward" flow through the plug. While "downward" and "upward" are used, the plug may be in a lateral portion of the well. In this event, directions are to be transposed as needed. The disclosed plug may have a multiplicity of shear pins or screws 140 located in the bottom subassembly or bottom sub 14/114 holding seat bearing pump-out ring 24/124 to the bottom of the plug (typically the lower sub). Seat 25/125 is provided for lower frac ball 27/127 to allow the ball to engage and permit increased fluid pressure from above. This arrangement permits opening the plug to flow-through by applying sufficient fluid pressure from the surface to the set tool to shear screws 140. Alternatively, a flapper (not shown) serves the same purpose. The resulting assembly when comprised of dissolving aluminum or PGA or dissolving compositions known in the art may be pumped away after dissolution.

Downhole tools 10/110 of FIGS. 1-6A, 9A and 9B, for example, may include a backup system comprised of pump-out ring 24/124 having a lower ball seat 25/125. Shear pins or screws 140 engage the pump out ring to mandrel 12/112 or bottom assembly 14/114 (see FIG. 4). The lower ball seat is sized and shaped to accommodate bottom or lower ball 27/127. Lower ball 27/127 may be run in with tool 10/110 on a wire line or setting tool (see FIG. 4C). Typically a perf gun in a plug and perf completion is pumped down hydraulically or moved down hole behind the tool and is used after the tool is set to perf the casing for subsequent fracing. However, in one method, if the first perf gun fails, it may need to be pulled out and another perf gun may need to be pumped down, for example hydraulically. In a typical situation using typical tools, this might require drilling out the plug. With plug 10/110, however, having pump out ring, lower ball, and shear pins, the pressure of the hydraulic fluid may be chosen to exceed the shear strength of shear screws 140 and thus the pressurized fluid will pump out lower ball 27/127 and ring 24/124. This permits the perf gun to be pumped to its desired location in the well without the necessity of drilling out or removing the plug.

The shear pins or screws may be designed and constructed of materials and sizes and numbers to provide a chosen cumulative shear strength and to shear at a chosen bore hole fluid top pressure/bottom pressure differential. A single screw may resist 1× pressure; two screws resist 2× pressure, etc. The number of pins may be varied at the well site ad hoc as needed for the particular well and particular formation location in the well. In one embodiment, the shear pins or screws are made of metal and have shear strength in the range of 800 to 1100 PSI per screw, if five screws were used (arranged as circumferentially evenly spaced as possible), a preferable range would be between 4000-5500 psi depending on the screws used. By varying the shear strength and screw number, the shear strength can be accurately set.

In an embodiment, wedge bottom subassembly or sub 14/114 may be provided with shear pins 140 threading through the walls into pump out ring 24/124 with ball seat 25/125. Ball seat 25/125 seats primary ball 27/127 on ball seat 25/125. The ball may be captured between keeper pin 129, which may be aluminum, or other suitable material dissolvable or non-dissolvable material, and seat 25/125. This acts as a check valve allowing relative flow of fluid between the lower end and the upper end of the tool, but checking flow the opposite way.

In one embodiment, shear screws 140 in FIG. 1 may be multiple; up to eight or more, placed radially around bottom sub 14/114. They may be aluminum or a non-aluminum metal such as a manganese bronze alloy. They may have a flat point for seating into groove 24*a*/124*a* in a ring 24/124 as seen in FIGS. 1-4A and 6, for example. In one embodiment, the number of shear screws engaging the groove may be varied up to the maximum, for example eight. The more screws engaged to the pump out ring groove the greater the pressure required to pump out the ring assembly. An anti-seize compound may be used during tool assembly between the inner surface of the mandrel and the outer surface of the ring to provide more accurate shear points, the pressure differentials at which the pins shear and the pump out ring is released, and to reduce "stiction". One such material is Loctite® Anti-Seize. Such a material may also be used between adjacent rings of the multi-ring split ring assemblies and at surfaces where cones meet the rings of the split ring assemblies to reduce the likelihood of friction interfering with the tool's intended functions when subjected to downhole setting pressures.

The plug with the pump out ring assembly may have a secondary or upper ball seat 26/126 in the top of mandrel 12/112 of the plug to seat a drop in secondary or upper frac ball 30/130 as shown in FIG. 4. The disclosed upper frac ball/upper seat combination is believed to be particularly useful in situations where frac sand or other debris might foul a single lower frac ball/lower seat combination or pump out ring assembly. An upper frac ball/upper seat combination may help protect a lower frac ball/lower seat combination or pump out ring assembly from frac sand and debris from upper zones fouling the lower frac ball/lower seat. The combination is preferably included in an aluminum plug as described herein, but may also be used in any conventional plug. In one embodiment, such as disclosed in FIG. 4, ball 30/130 is "free" and may be dropped into the casing after the tool is set (and after the pump out ring is pumped out, if one is used). In another embodiment, as seen in FIGS. 2, 3, 4A, 9A and 9B, ball 30/130 is run in with the tool.

Figure 6:
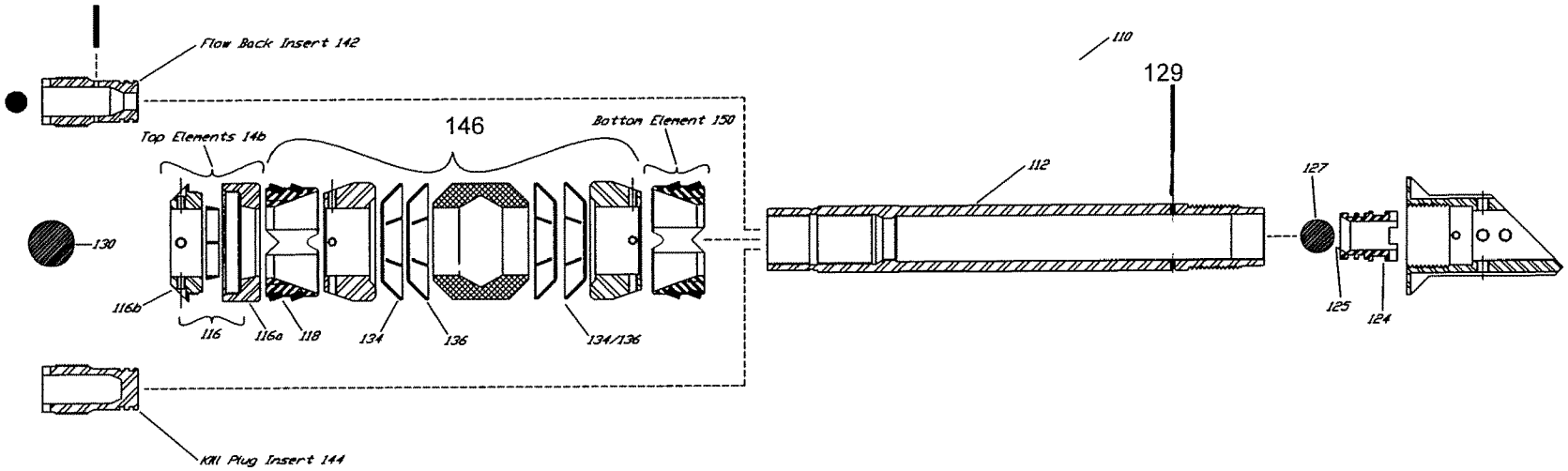
FIG. 6 is an alternate embodiment of a downhole tool in an exploded cross-sectional view showing multiple interchangeable kit parts for fitting to a common subassembly comprising a kit.
Figure 6A:
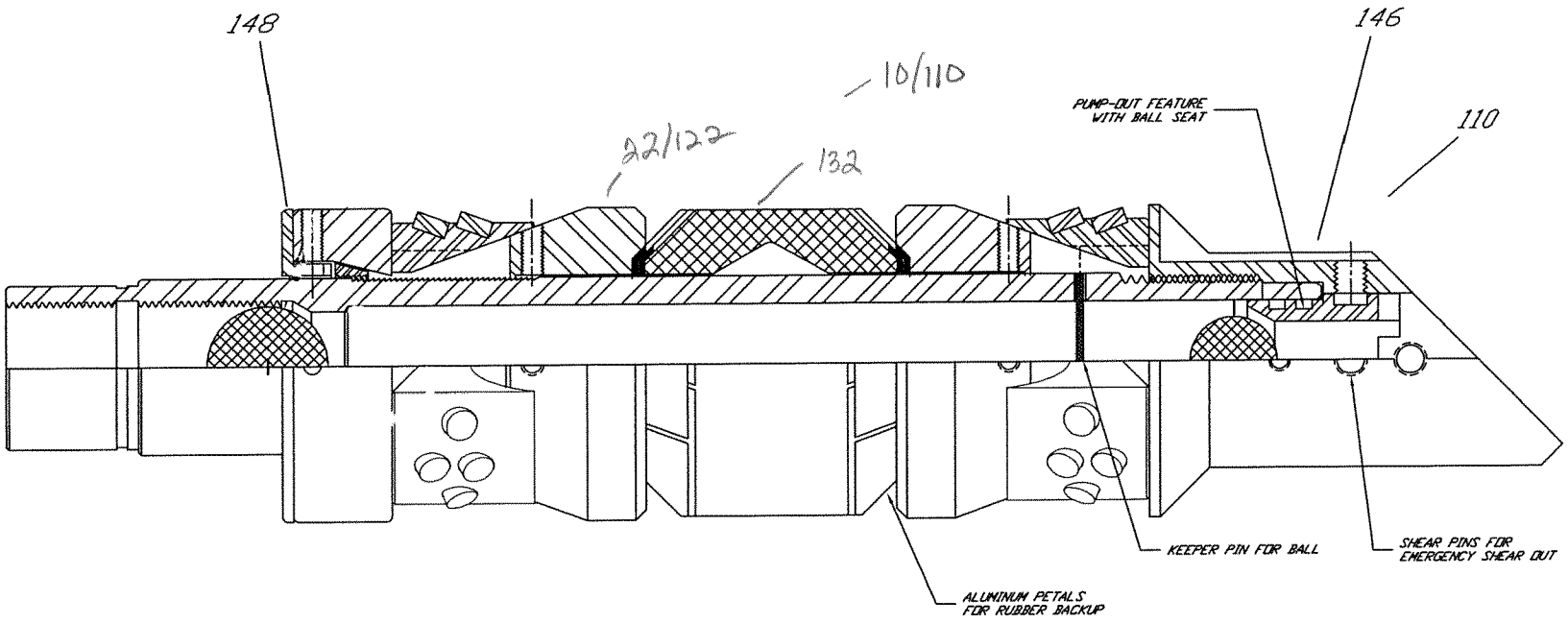
FIG. 6A is an assembled view of the FIG. 6 kit parts
Figure 9A:
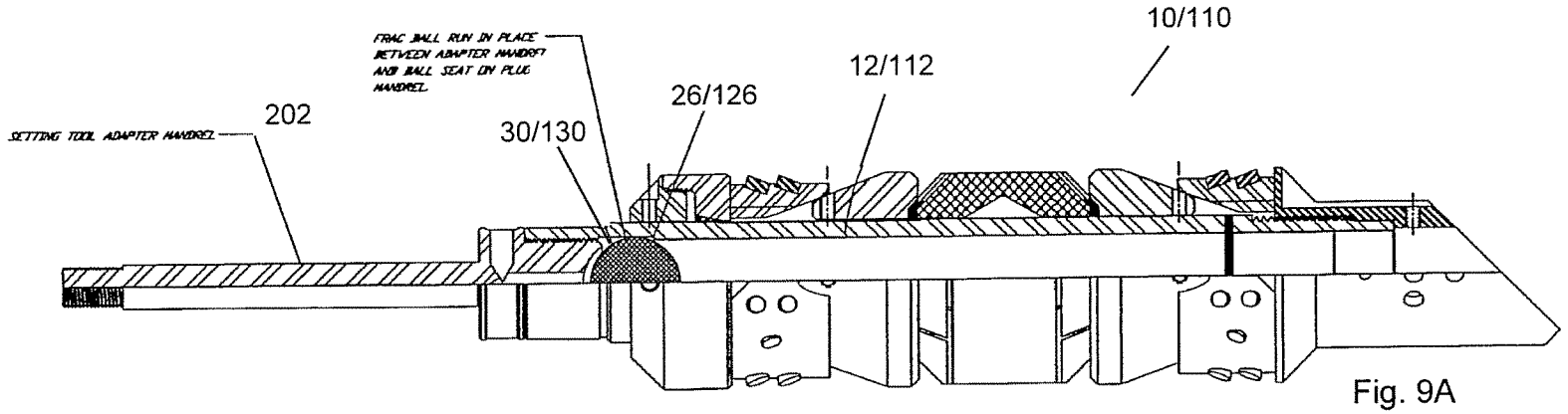
FIGS. 9A and 9B illustrate partial cross sectional views of a setting tool adapter mandrel for running in a ball with a plug.
Figure 9B:
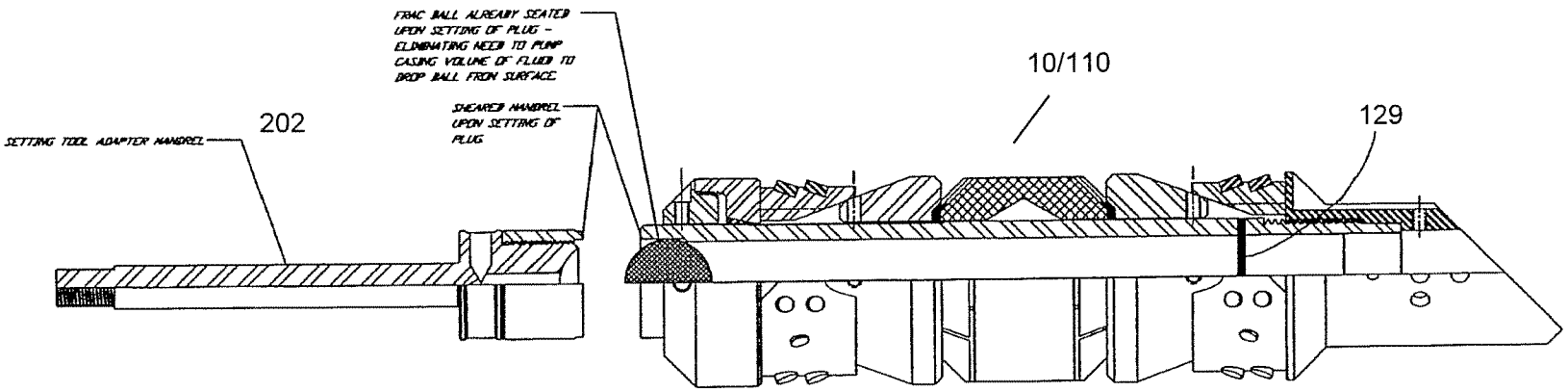

In one embodiment, upper ball 30/130 FIGS. 6, 9A and 9B, for example, may be run in ahead of the functioning perf gun (plug and perf) to engage upper ball seat 26/126. Bottom ball 27/127 may be pumped out as described above or dissolve in wellbore fluids. Upper ball seat 26/126 is provided for frac ball 30/130 to seat against. In one embodiment, frac ball 30/130 is dissolvable and may subsequently dissolve, to open the tool to fluid flow. This provides a backup system if an up-well perf gun or other tool does not function as desired. In an embodiment, upper ball seat 26/126 is provided for a dissolvable frac ball to seat against. The frac ball may subsequently dissolve, typically following fracing. As seen in 4C, 6A, 9A and 9B, for example, a multi-stage setting tool 206, such as an Owen 2⅛" OD Go Multi-stage setting tool may engage an adapter mandrel 202 and setting sleeve 204 any single stage hydraulic ballistic or even manual setting tool may be used. The removed end of the adapter mandrel 202 may threadably engage a threaded near end portion 112*a*, having a shearable narrow section 112*b*. When the tool is run in on a wireline, a ballistic charge will shear the narrow section, setting the tool and leaving ball 30/130 in place for subsequent fracking and other completion operations.

The disclosed dissolvable tool or tool with a pump-out ring tool may be suitable for fracing, acidizing or other zone isolation functions. The tool may permit an upper zone to be isolated from a lower zone of lower fluid pressure, while also allowing fluid flow from below the tool responsive to a changing pressure differential. See FIGS. 10A-10E. If needed, pressure from above primary ball 27/127 and ball seat 25/125 on pump out ring 24/124 may be provided, which pressure exceeds the strength of shear pins 140 to permit, following pump out, fluid flow through bore 12*c*/112*c* of mandrel and flow there through. Bottom subassembly 14/114 is seen in one embodiment to be wedge-shaped, so it may lock with cooperating wedge elements on tools set below it after release, if need be, in ways known in the art.

With Applicant's tools 10/110 or as otherwise disclosed, a frac ball may be dropped, post setting or run in place on the mandrel using a setting tool adapter 202, FIGS. 9A and 9B, with or without a check valve assembly (in one form, the pump out ring assembly). For a frac ball run in with the tool, this is a water or other fluid saving feature, permits pump pressure to immediately seat the frac ball, and eliminates the step of having to pump at least a casing volume of fluid to carry a frac ball down from the surface to the seat, prior to fracking.

D) Expandable Split Ring Sealing Element

Rubber and other elastomeric materials function well as seals and are commonly used as seals in tools and machinery ranging from downhole oil tools to automobiles. The sealing element between the plug and casing in conventional plugs is typically an elastomeric seal comprised of a rubber or a rubber-like elastomer. Conventional plug sealing elements have been comprised of elastomeric materials for decades. Bridge plugs are typically run in with a setting tool that may be ballistic, hydraulic, or electric as known in the art, which sets the plug by pulling the bottom of the plug up relative to its top, the longitudinal compression which moves the wedges longitudinally, which forces slips radially outward to grab or engage the casing inner wall. Further pulling upwards on the bottom of the plug, compresses the slips longitudinally against the plugs' elastomeric seal which forces the elastomeric seal radially outward and against the casing. Being forcefully pressed radially against the casing, the elastomeric seal conforms to the casing inner wall, creating an effective seal against fluid flow between the plug and casing.

However, plugs such as frac plugs, bridge plugs, packers, and the like must both seal the wellbore during the well completion operation, and then also sometimes subsequently permit fluid flow through the wellbore. Rubber functions well as a seal material in downhole tools during the first function. Restated, after the plug's sealing function ends, the plug unhelpfully obstructs the next function, which is permitting fluid flow through the wellbore. The second object, permitting fluid flow, is conventionally accomplished by milling out the plug. However, milling out plugs which have rubber or rubber-like seals sometimes creates problems. When the milling head encounters a rubber seal its elastomeric nature sometimes causes it to gum up the milling head and to sometimes leave gummy debris in the hole. These can sometimes both the problems. These downhole tool elastomeric sealing element problems have existed for decades. There is a long felt need to alleviate these problems.

Figure 3:
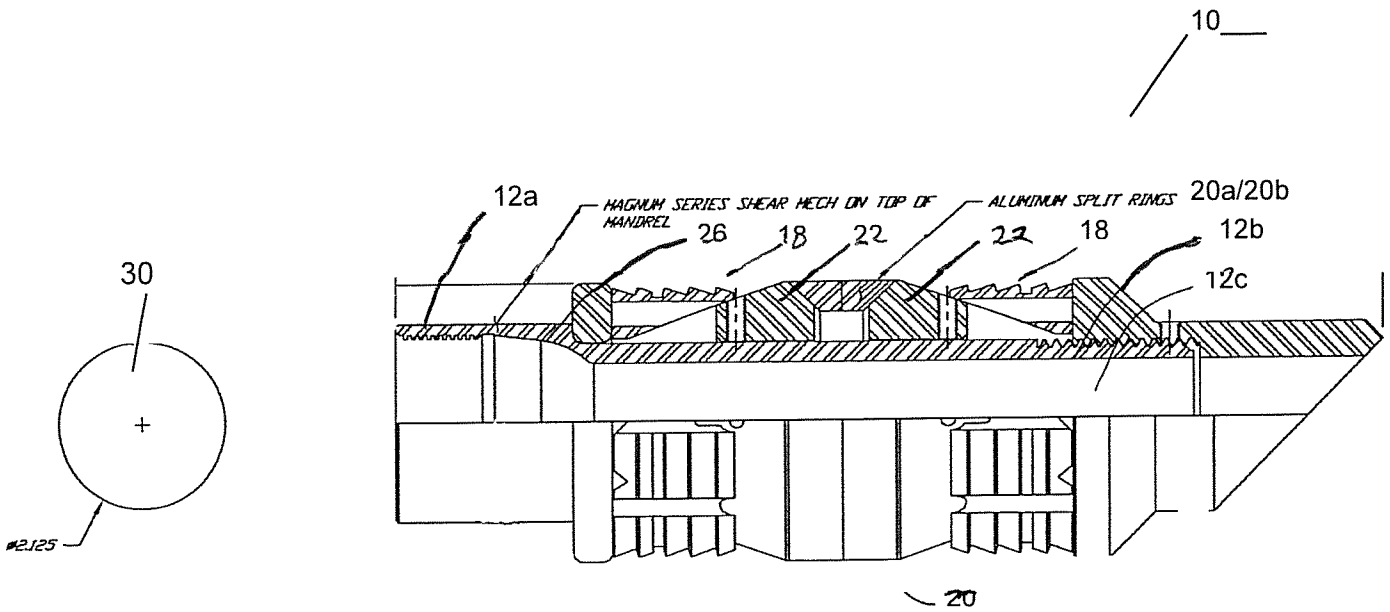
FIG. 3 is an external side view of an embodiment of an aluminum plug without the pump-out ring, but in a ball drop configuration and having splint rings.
Figure 3A:
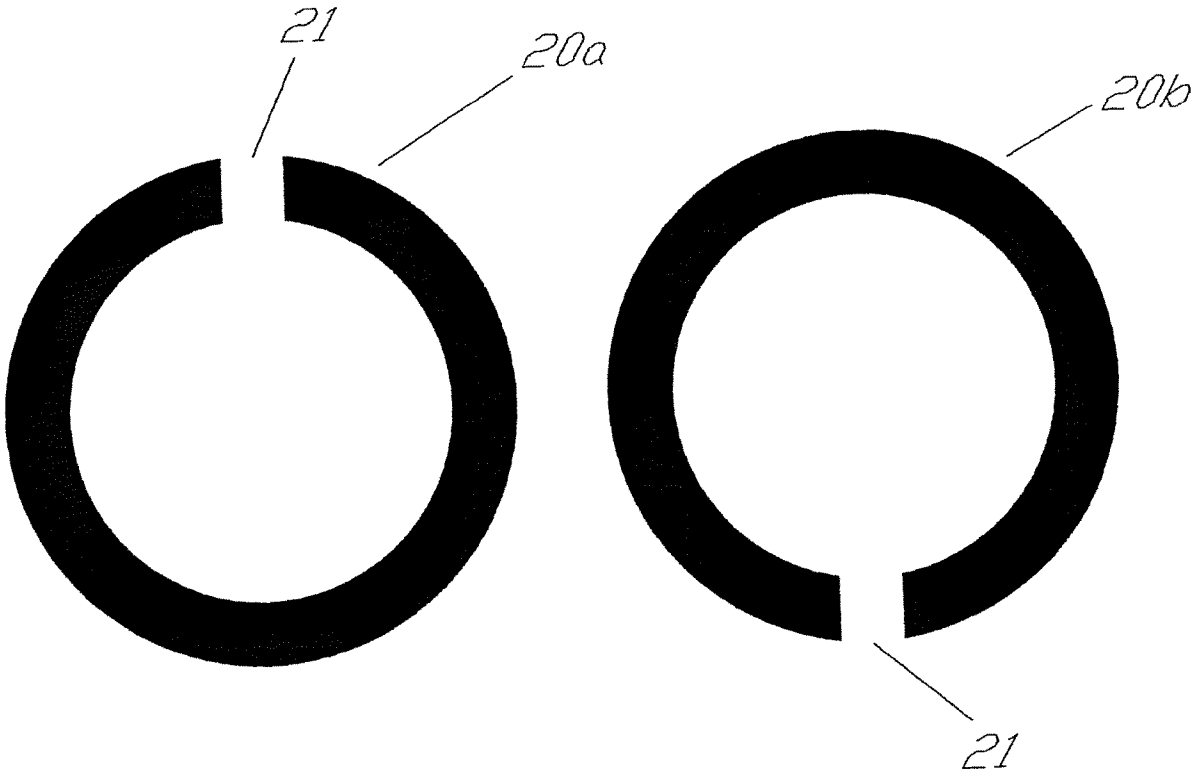
FIG. 3A is an illustration of one embodiment a split ring assembly used as a sealing or pack off element.
Figure 3B:
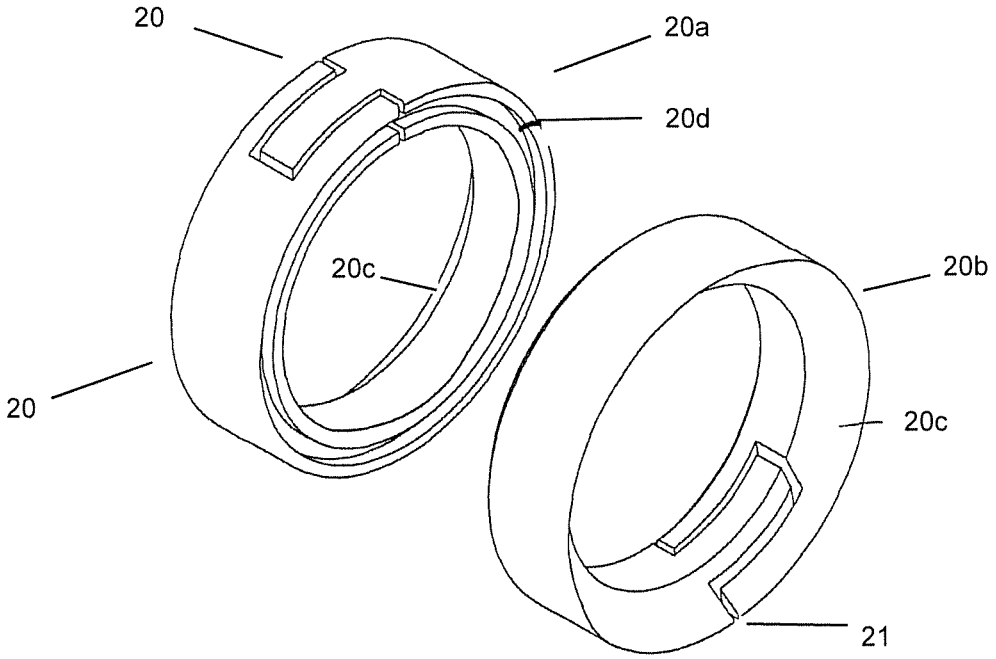
FIGS. 3B (exploded perspective) and 3C (perspective) illustrate a split ring assembly having two aluminum sealing rings.
Figure 3C:
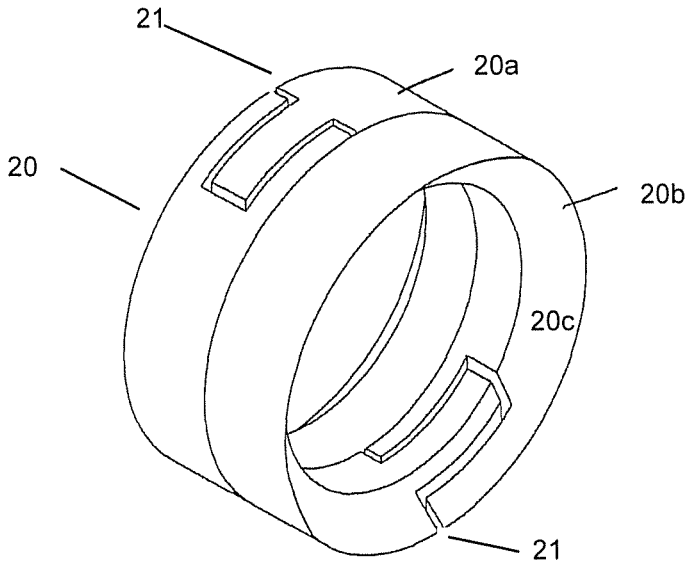
FIG. 3D is a perspective view illustration of a one-piece embodiment of an aluminum sealing ring.
FIG. 3E is an external side view of a plug with a split ring assembly with multiple partially split (pre-set) rings, pre-test in pre-set position.
FIG. 3F is an exploded cross-sectional partial illustration of the plug of FIG. 3E, pre-set.
FIG. 3G is an external side photograph of the plug of FIG. 3E as tested (casing cut away), post-test with sand.
FIG. 3H is an external side photograph of the plug of FIG. 3E as tested (casing cut away), post-test without sand.
Figure 3D:
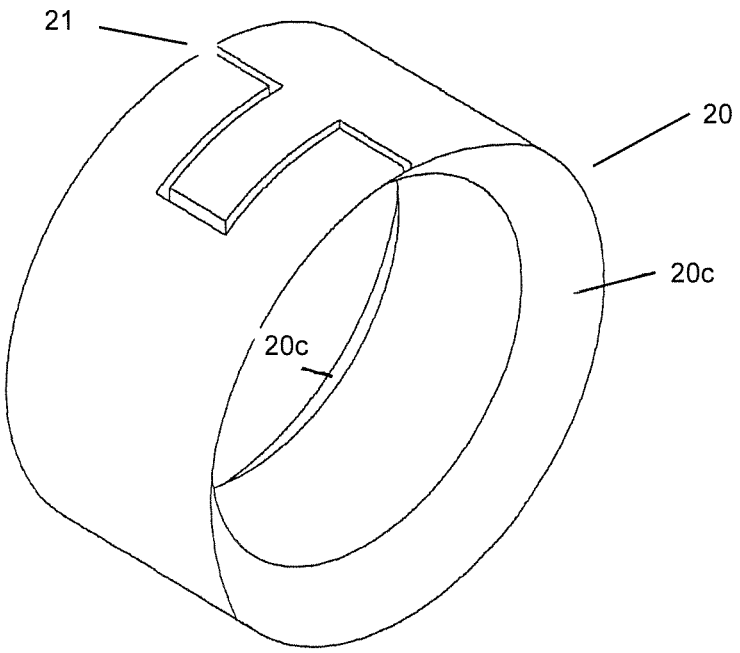
Figure 3E:
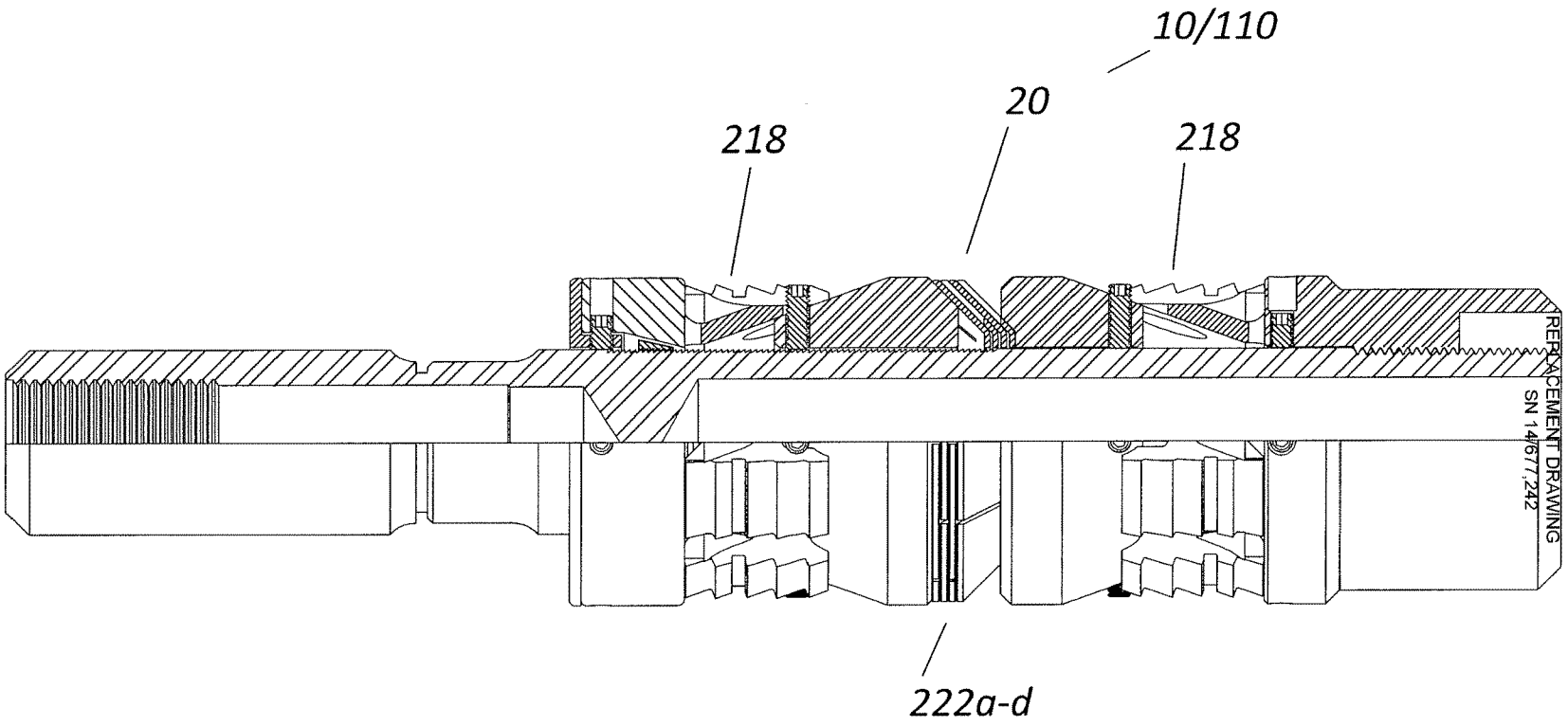
Figure 3F:
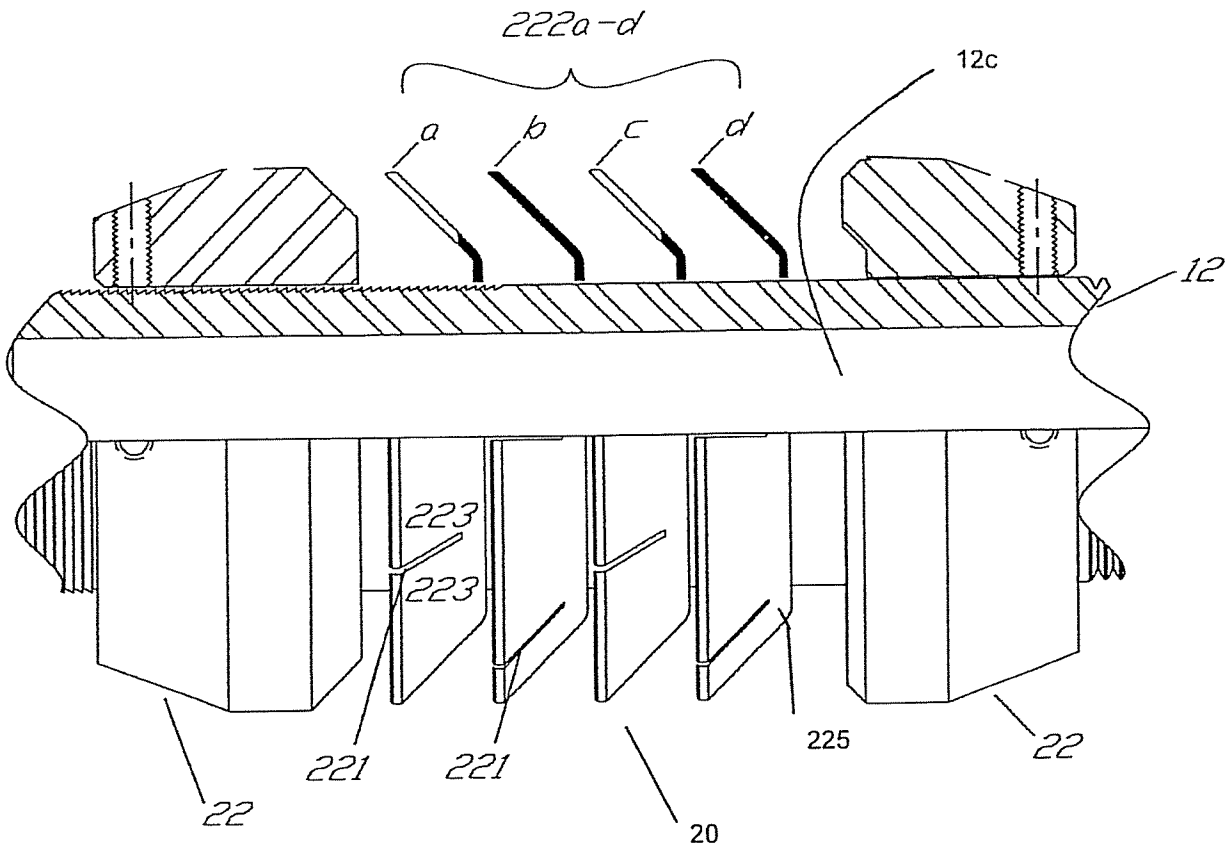
Figure 7A:
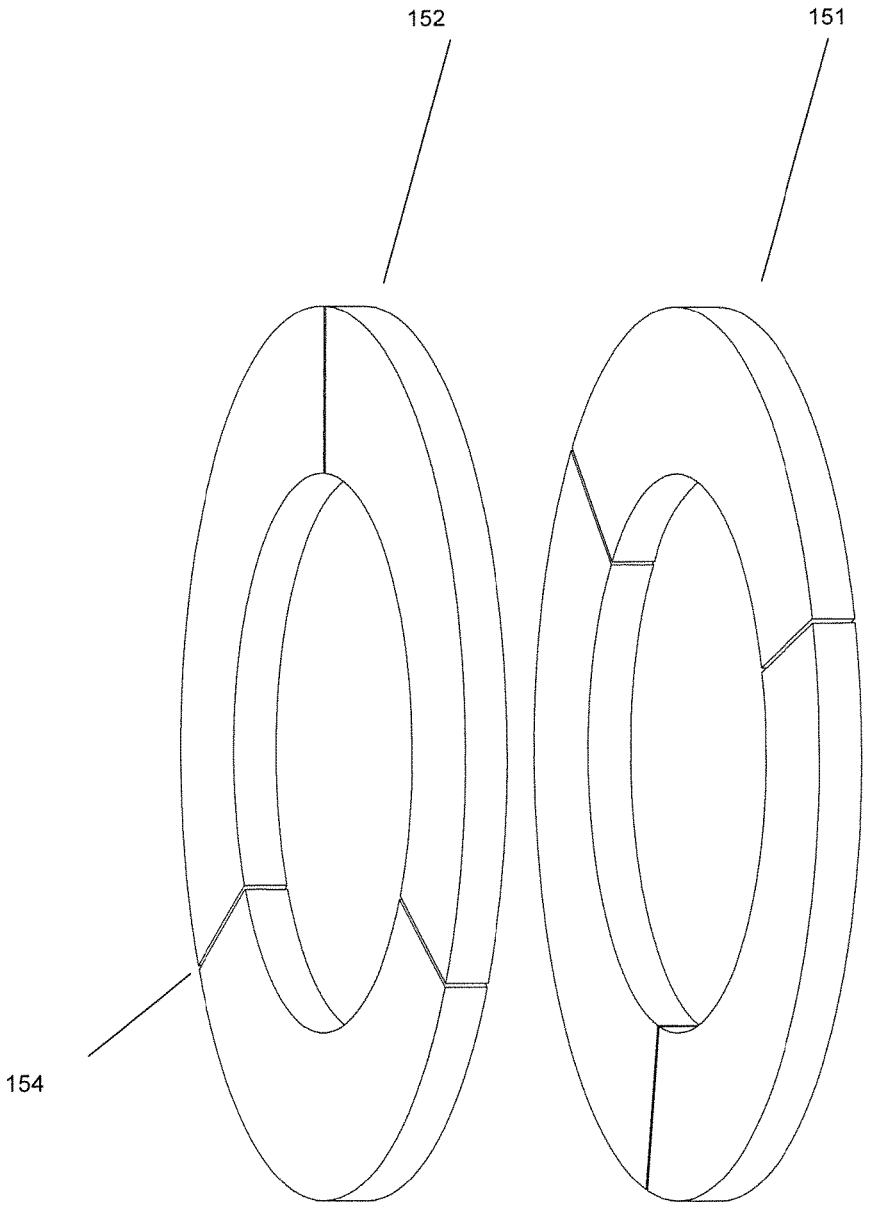
FIGS. 7A, 7B, and 7C illustrate an alternative frangible discs split ring sealing rings.
Figure 7B:
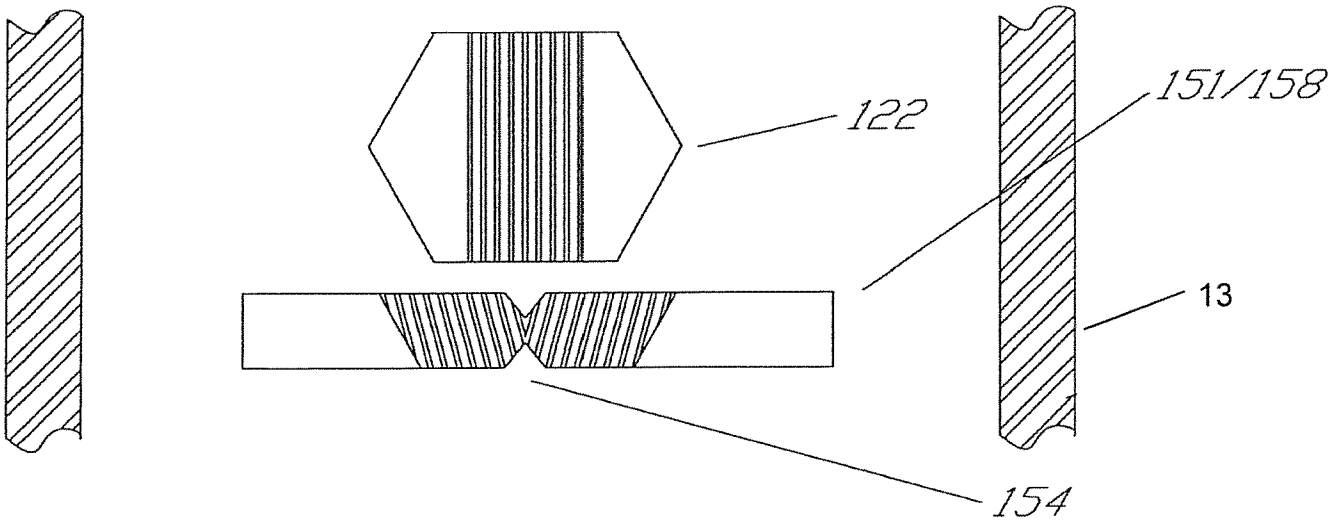
Figure 7C:
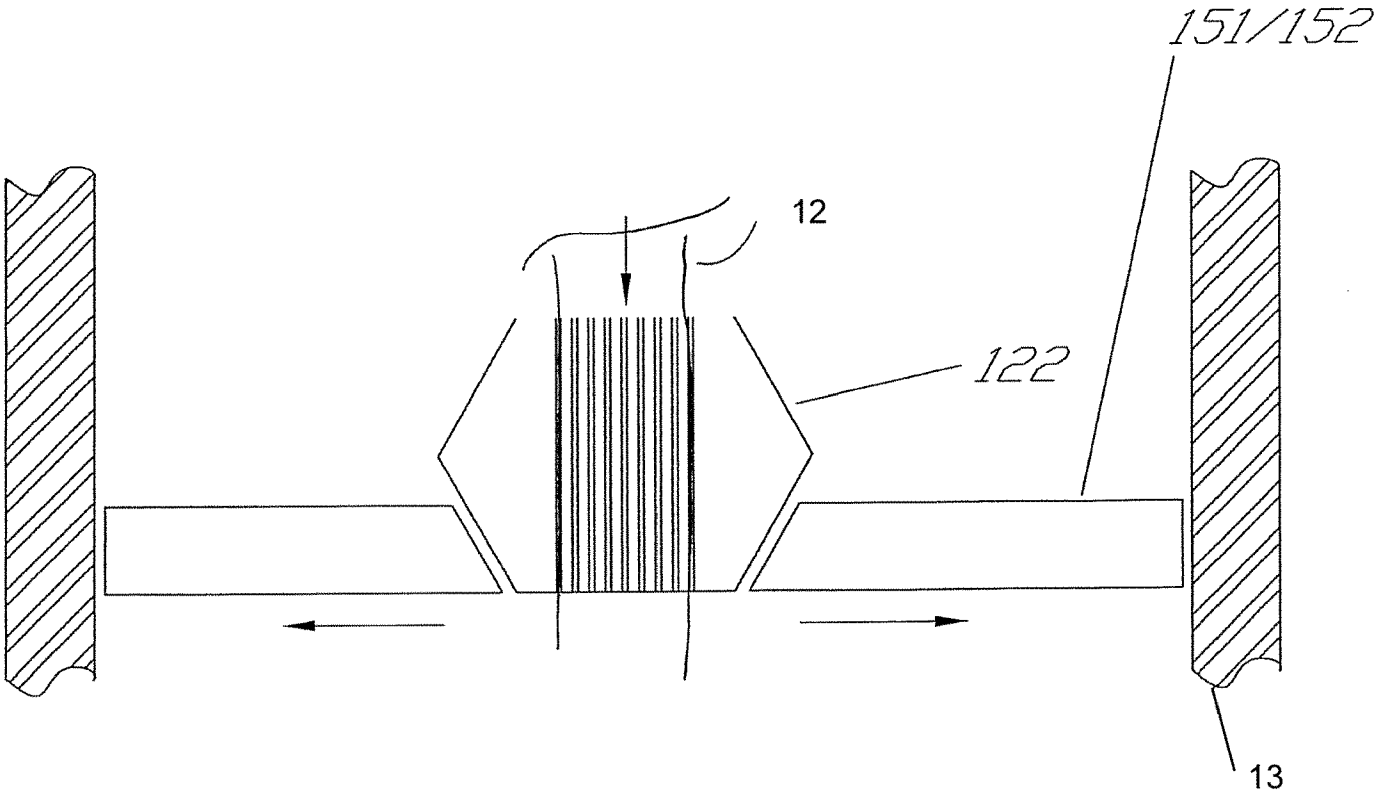
Figures 8A, 8B:
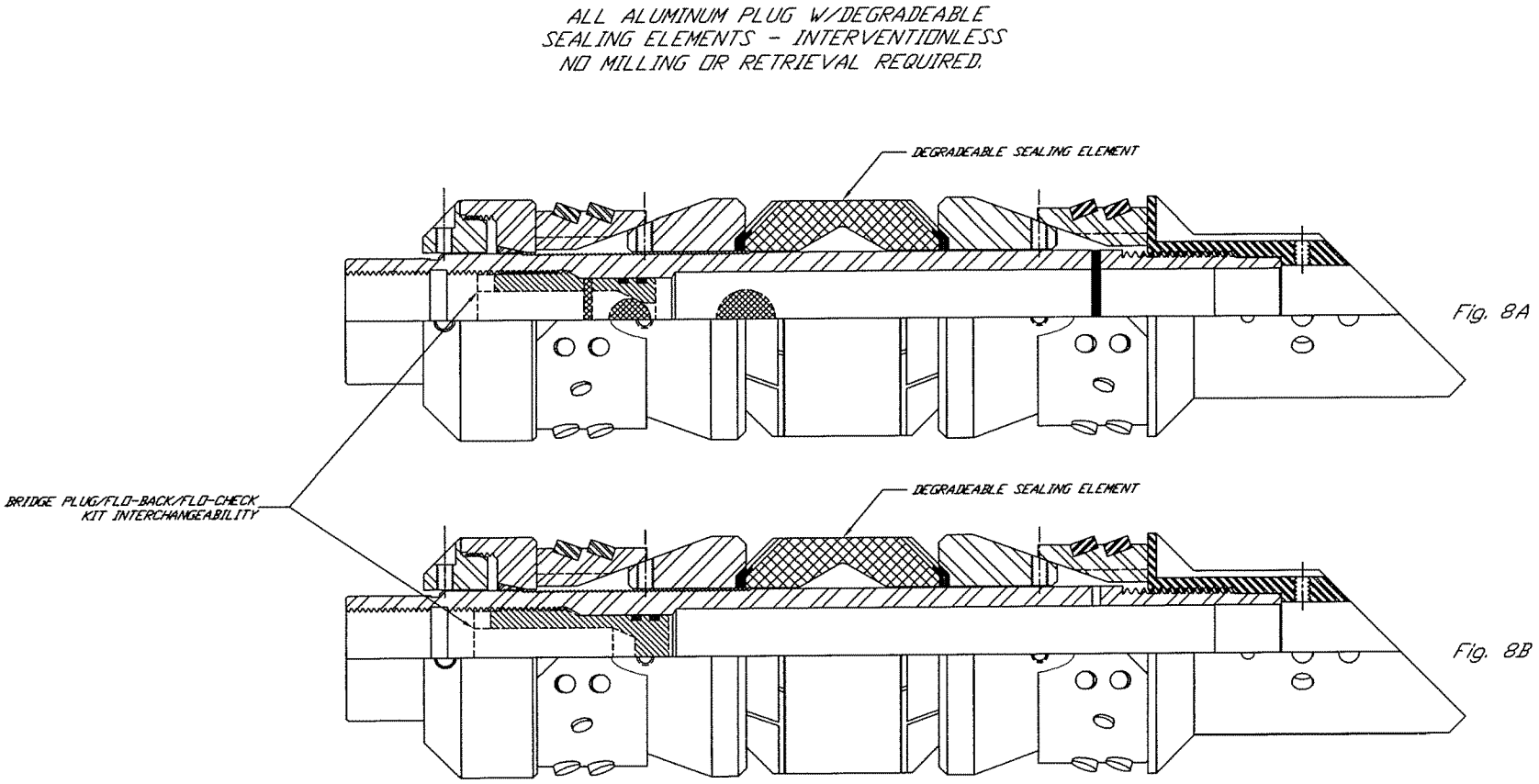
FIGS. 8A, 8B, 8C, and 8D are partial cross sectional views of a kit assembly showing part interchangeability for a subassembly and use of a dissolvable aluminum structure with a degradable elastomer.
Figures 8C, 8D:
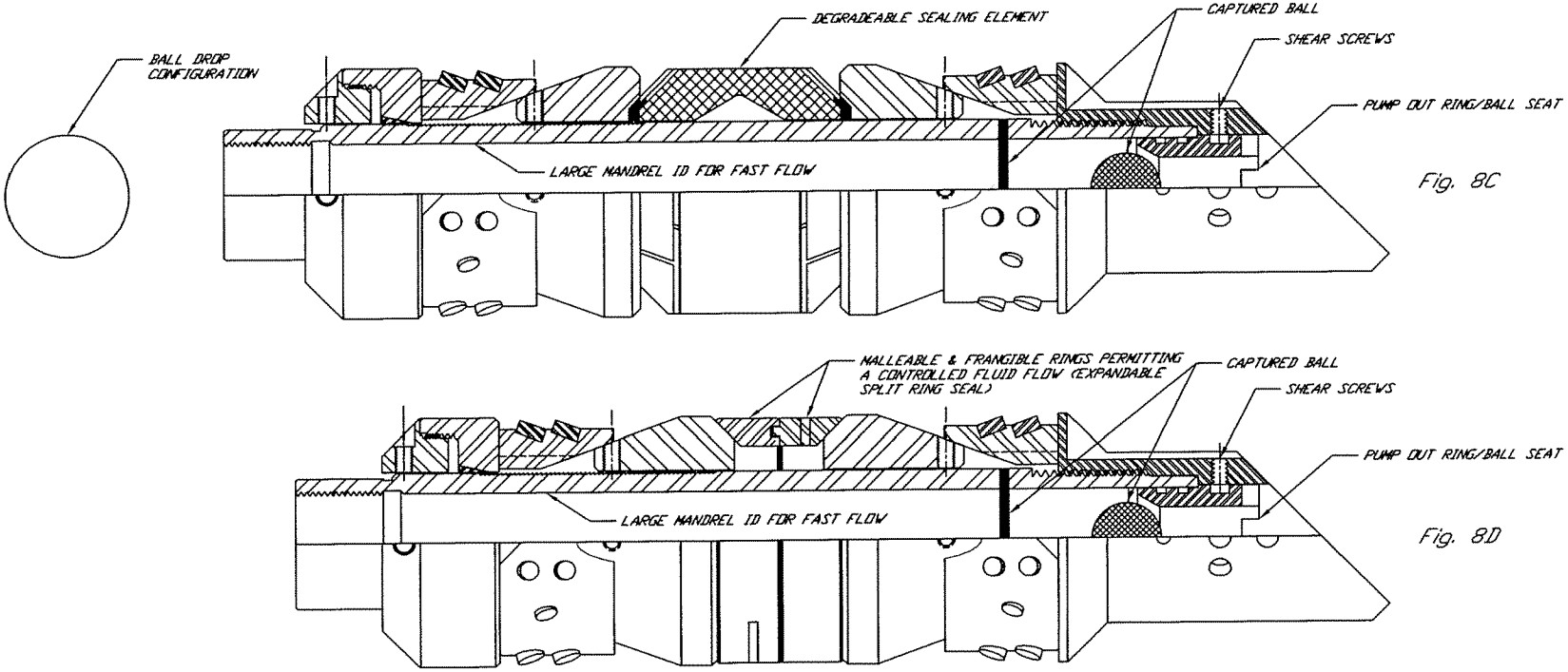

The disclosed embodiments permit the sealing element to be comprised of a split ring rather than a solid, unsplit rubber or rubberlike elastomer. In some of the disclosed embodiments, a sealing element is shown which does not gum up the milling head or leave gummy debris in the hole. In some of the disclosed embodiments, a metal sealing element does not have to be drilled out, but rather degrades together with the plug generally in the presence of production fluids or fluids added from the wellhead. The "expandable ring" element described here serves similar functions to a conventional rubber or rubber-like elastomer seal, namely to seal the plug against the inner wall of the casing to preclude fluid movement around the plug and through the casing. When compressed or crushed between the plug's wedge elements and slips during setting the plug, the outer edges of the expandable split ring radially expand out against the inner surface of the well casing, sealing the plug to the casing. As used herein, an expandable ring has an inner perimeter and an outer perimeter, is located about the mandrel of a plug, is comprised of metal, and is capable of being wedged radially outward or compressed during setting the plug, causing the rings' outer edges to radially expand out against the inner surface of a well casing, causing the plug to seal the wellbore against fluid flow through the wellbore between the plug and the casing. In one embodiment, expandable split ring sealing element structures such as split ring assembly 20 may encompass (1) fully cut through cylindrical metal rings as shown in FIG. 1, 3, 3A-D, cut through substantially from its outer perimeter to its inner perimeter, such as 22*a-b* (2), partly cut through frustoconical rings as shown in FIGS. 3E-F with partial cuts or gaps 221, running partly through a ring from an outer to an inner perimeter, defining vanes 223 there between, (3) frangible (weakened) rings as shown in FIGS. 7A-C, comprised of one or more continuous malleable or frangible rings 151/152 including frangible rings with multiple weakened areas such as grooves 154. The term split ring describes the post set configuration of all three of these embodiments as well as the pre-set configuration of embodiments (1) and (2). All may be used in place of a conventional elastomeric seal element or pack off element. The term split ring assembly typically includes multiple ring elements, but may have a single ring (see FIG. 3D for example).

The thickness of the rings may be varied; thicker rings typically providing greater setting strength see FIG. 3F1. While aluminum, meaning any aluminum alloy or pure aluminum, is often mentioned in the specifications, the aluminum need not be configured or adapted to be dissolvable. Indeed, the split ring assembly may be made from non-dissolvable materials, including ductal iron, in one example ductal cast-iron frangible rings as seen in FIGS. 3B and 3C. When the rings are made of non-dissolvable materials, they are milled out in ways known in the art.

D.1 Full Split Rings

Expandable aluminum (or other suitable material) split rings may be used in place of prior art elastomers (or the degradable elastomer disclosed herein) in setting any type of tool. This provides an "interventionless" (no retrieval or drill out) method of completion or reworking a well without the use of, or with reduced use of, permanent plugs and without problems caused by drilling out rubber or rubber-like elastomers.

The disclosed plug 10 of FIGS. 1, 1A, 2, 3, 3A-D and 8D has an expandable metal ring sealing element comprised of multiple split rings 20A/20B rather than an elastomeric sealing element.

Instead of seal elements comprised of an elastomer, various embodiments of disclosed split ring assembly 20 (see FIGS. 1, 3E and 7A) may be comprised of two or more aluminum (or other suitable resilient, split metallic or non-metallic material) split rings 20*a*/20*b* entrained about the exterior of a plug's mandrel on or near center or on either end. Split rings 20*a*/20*b* are positioned, comprised, and sized to be compressed along the tool's longitudinal axis and expand radially outward during setting. Outward expansion of the split rings, facilitated by the splits, creates an outward wedging effect against the inner casing wall which substantially seals the plug to the inner casing wall and impedes fluid flow around the plug.

FIGS. 1, 3B and 3C show a pair of interlocking split rings 20*a*/20*b* having their gaps 21 about 180 degrees apart. Inner facing wall of one ring (20*a* in FIG. 1) has a lip 20*e* that fits into groove 20*d* of the adjacent ring. In another embodiment FIG. 3, the facing walls are flat and flush to one another. In yet a third embodiment, FIG. 3D, a split ring assembly 20 having a single split ring is provided with opposed canted walls 20*c*, each engaging one of the pair of cones 22 on either side.

In one disclosed embodiment, preset gaps 21 are cut fully through from the inner diameter to the outer diameter of the ring. Setting is accomplished, similar to a plug with a conventional elastomer sealing element, by maintaining the position of upper assembly 16/116, while mandrel 12/112 is pulled upward (relatively), forcing wedge bottom sub 14/114 towards the top ring, causing pair of aluminum slips 18/118 with non-aluminum buttons or inserts 19/119 of cast iron, tungsten, carbide, or ceramic inserted on the surface thereof to wedge against inner wall of casing 13. Rather than an elastomeric seal, the disclosed embodiment has, in one embodiment, split rings 20*a*/20*b* (and in other embodiments rings 220*a-d* in FIGS. 3E, E1, F, G and H as well as rings 151/152 in FIGS. 7A-C). Continued compression forces split rings 20*a*/20*b* to spread outward against the casing inner wall. It is seen that on wedge or cone elements 22 with canted walls 22*a* (FIGS. 3, 3C and 3D), when the split rings are driven one towards the other, ride on wedge elements 22 as their outer circumference expands (gap 21 opens). When the outer surface of the rings are forced against the inner wall of the casing, this creates in one embodiment an aluminum to steel bond, sufficiently sealing the plug against the casing. Note that pre-set, gaps 21 are cut fully through from inner to outer diameter of the ring.

Preset gaps 21 facilitate this radial expansion, reducing split ring resistance to expansion and defining where the expanding outer ring will typically separate during its expansion. This controllable separation of the rings permits predetermination of where the expanding rings' expansion gaps, splits or breaks will occur. Preset gaps 21 are offset from each other. In this configuration, a preset gap of one ring and a solid portion of an adjacent ring are paired. The preset gaps and solid portions are arranged so bore fluid may not directly pass up or down the borehole through the plugs' preset gaps without being obstructed by a ring solid portion. Preferably the obstructing solid portion will be of an adjacent ring. After the plug is set, the radially expanded rings' preset gaps are expanded due to their having less resistance to radial expansion than the ring solid portions. They are now post set gaps. The post set gaps are arranged so borehole fluid may not directly pass up or down the casing borehole through the post set gaps without being obstructed by ring solid portion of at least one other ring. Preferably, the obstructing solid portion will be of an adjacent ring.

D. 2 Partly Cut Rings

The plug of FIGS. 3E, 3E1, 3F and 3F1 (as well as the photos of FIGS. 3G and 3H) has an expandable split ring sealing assembly 20 comprised of multiple frustoconical shaped rings 220*a-d* split rings (which may be metal) rather than an elastomeric sealing element. This tool or plug 10/110 is similar in construction to plugs 10 and 110, but as shown, illustrates use of convention slips 218 (although any slips may be used). The preset rings have splits or gaps 221 which extend inwardly from the rings' outer perimeter toward the rings' inner perimeter, stopping short of the rings' inner perimeter, in their pre-set configuration, see FIG. 3E.

Some conventional plugs have grooved metal wedges in association with and on either side of a central elastomeric or malleable sealing element. U.S. Pat. Nos. 7,762,323; and 8,899,317, both having W. Lynn Frazier as the inventor, are incorporated herein for all purposes. In some of this application's embodiments, split ring assembly 20 does not include a central elastomeric or malleable sealing element, but rather replaces it.

Figure 5:
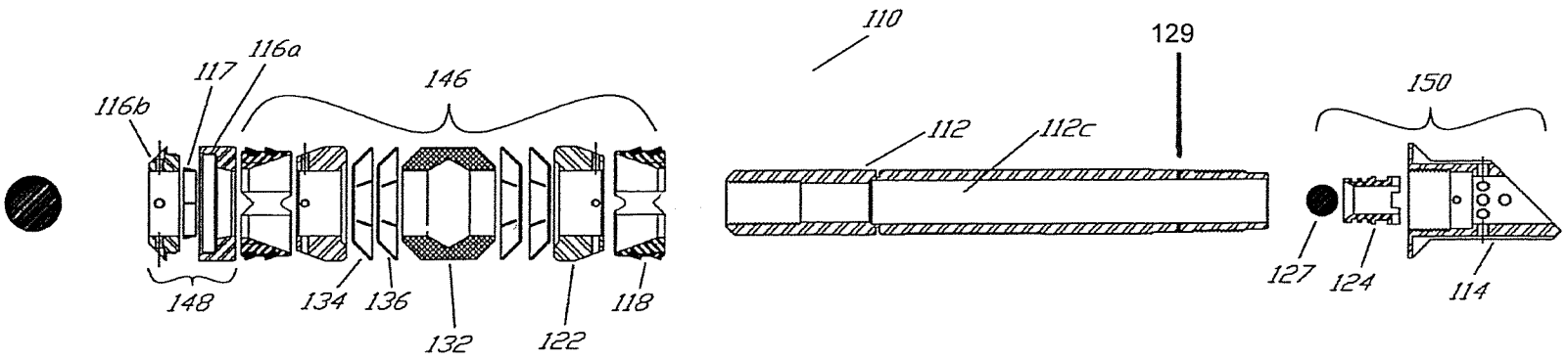
FIG. 5 is a partial cross-sectional and exploded view of a plug with a dissolvable elastomeric pack off as sealing element.

Gaps 221 create petals or vanes 223 which spread outward during setting. The open cones may tear through base 225 during setting (see FIG. 3E1). There may be two or more open cones with the petals and grooves staggered as seen in FIG. 5, that is, an "asymmetrical" split ring sealing assembly 20 as shown in FIGS. 3E, 3E1, 3F, 3G and 3H. In an embodiment, the open cones are not paired with adjacent cone/ring assemblies as seen in FIGS. 1, 2, 3 and 7C, for example, with a mirror image of rings set on the other side of the center of the mandrel. In one embodiment, in an asymmetrical application of frustoconical, partially split rings, the highest pressure is anticipated from the left to right as seen in FIGS. 3E and F. These may be used in a frac plug application. Such a seal may not immediately seal as well as an elastomeric seal. Sand may be run in with or after frac fluids, to help "jam" around the seal formed by the expansion of the "semi-split" rings against the inner casing. Fluid flow through the staggered petals compressed and bent against the casing, directs the sand to fluid openings, causing the sand to plug the openings and seal the wellbore against further fluid flow.

The preset outer diameter of the split rings may be measured before the tool is inserted into the borehole, see FIG. 3F2. The set outer diameter of the rings is measured by setting the tool outside of the borehole, where expansion of the rings is not restricted by the casing. The preset outer diameter of inner frustoconical rings 220*b-c* may be greater than outer rings 220*a-d* of a multi-ring assembly in one embodiment, see FIG. 3F1. The inner rings may be more numerous, softer and thinner than the outer rings (see FIG. 3F1) to deform more completely and sealingly against the inner wall of the casing than the outer rings. The multiple overlapping and deformed inner rings more completely seal against the casing and their resulting interstices catch and are plugged by post setting additions of sand or other particulate material flowed through them or dropped on them. The preset configuration of the rings may be configured so the rings do not extend out beyond the outer diameter of the tool. A set ring/casing overlap in the range of about 0.25 to 1.00 inches, the overlap being the difference between the outer diameter of the ring or rings in a set condition when there is no casing to interfere with their expansion and the inner diameter of the casing. This overlap distance indicates the length of ring deformed against the casing as the rings set against the casing.

Inner walls 22*a* of the wedges seen in FIG. 3F1 may be notched, sloped, straight or any other shape suitable to push rings 20*a/b*, 151/152, 220*a-d*, and 220$a^1$-$d^1$ (FIG. 3F1) rotate from their base and extend further radially outward during setting, to jam the outer parts of the rings against the inner wall of the casing.

The shape of the outer edge of any ring may be sloped, curved, irregular, or flat. The outer part of the rings are flush with the inner casing after setting.

D. 3 Frangible Rings, Grooved but Uncut in Pre-Set Configuration.

The expandable metal ring sealing element shown in FIGS. 7A-C is comprised of one or more continuous malleable or frangible rings 151/152 rather than an elastomeric sealing element. Setting the plug expands the rings radially outward, the expansion breaking the rings at one or more predetermined and pre-located radial weakened areas or grooves 154 so the rings separate along the groove and substantially seal at their outer surfaces against the inner casing wall. An embodiment of the rings and their use with a plug is shown in FIGS. 7A, 7B and 7C.

In an embodiment, continuous (that is, not split in an unset condition) rings 151/152 have breakable separation grooves 154 as shown in FIGS. 7A-7C on upper and/or lower surfaces, or lines of multiple weakening holes (not shown). A ring may have one or more separation grooves 154. There may be more than two rings, such as four (two on each wedge) or six, etc. Separation grooves 154 are shaped and sized so ring or rings 151/152 are continuous and securely held about mandrel (now shown in FIGS. 7A-7C) until setting begins, but will preferentially separate along grooves 154 when wedges 122 force rings 151/152 radially outward during setting of the tool. Separation grooves 154 may be offset or staggered between the stacked adjacent rings so the grooves in the rings are not aligned. This helps prevent fluid in the well from flowing directly through aligned openings in stacked rings after the tool is set and the rings broken at the separation grooves, or to slow fluid flowing through the broken stacked rings after the tool is set. Without the separation grooves, the rings may separate uncontrollably during setting. For example, without separation grooves the rings may break along the same longitudinal plane, providing a continuous longitudinal path for pressured borehole fluid to travel through the sealing element. Controlled breaking of the rings permits determination of where the breaks should be to best prevent fluid flow or leakage through the post set non elastomeric sealing element.

In another embodiment, a single ring or rings such as rings 151/152 are used, but in contact to the above, the ring is sufficiently malleable to be forced outward and seal against the casing without breaking. A soft aluminum is an illustrative such material. In addition to the malleable metal deforming without breaking its malleability enables it to seal against the casing.

D.4 Progressive Sealing

Decades of designing, making and using plugs in well completions with the object of creating a perfect fluid tight seal between the plugs with the casing teach against designing, making and using of plugs in well completions which do not have the object of a plug/casing perfect fluid tight seal. The several expandable metal ring sealing elements described here, split rings, frustoconical rings, frangible rings, etc., may or may not initially, or ever, either create a plug/casing perfect fluid tight seal, or create as good a fluid tight seal with the casing, as a conventional elastomer sealing element to casing seal. However, the resulting expandable metal ring/casing sealing element created by the described sealing element structures is not always a perfectly fluid tight seal, but rather is only "tight enough," that is tight enough so the spaces between the expandable metal rings and the casing and between the metal rings themselves are sufficiently small that the further sealing processes described here may usefully progress to further tighten the expandable metal ring to casing seal and the seals between the metal rings against fluid flow.

In an embodiment, the metal, such as aluminum, chosen for the expandable metal rings may be more malleable than the steel casing. A metal ring which is softer than steel somewhat conforms to the inner casing's imperfections and variations when forcefully expanded against it. A softer aluminum expandable metal ring creates a tighter expandable metal ring to casing fluid seal than would be created by a hard steel expandable metal ring to casing fluid seal under similar conditions. During run in, the outer surface of the degradable metal ring is degraded by wellbore fluids. During setting, the outer surface of the expandable soft metal ring is forced against the inner casing wall where the degraded, soft outer surface of the expandable metal ring sufficiently conforms to the inner casing wall to create a sufficient seal between the rings and the casing inner wall to sufficiently seal the casing from further fluid flow. A typical metal expandable metal ring has some irregularities on its outer surface. Likewise, aluminum which is softer than steel creates a tighter adjacent expandable ring to expandable ring fluid seal than would be created by adjacent steel rings under similar conditions. The spaces left between malleable elements compressed together are less than the spaces left between less malleable elements compressed together. In an embodiment, a plug is designed, made and used with these advantages as objects.

In an embodiment, the rings may be made of malleable metal material such as aluminum and are sufficiently malleable that the setting pressure on the rings squeezes them radially outward against the inner casing wall, sealing the outer edges of the rings against the inner casing wall. In an embodiment, the rings are comprised of a malleable aluminum or aluminum composite which dissolves in a well's acidic fluid more quickly than a similar ring dissolves in the well's acidic fluid. The outer surface of rings comprised of such a material is dissolved by the acidic wellbore fluid and the dissolving outer surface provides a better seal against the casing than a ring which does not dissolve in acidic wellbore fluid.

In an embodiment, at least the outer surface of expandable metal rings is comprised of a material which sufficiently partly degrades and becomes sufficiently more malleable due to being in the presence of the wellbore fluids during the plug's run in, before setting the plug, and after setting the plug so the degraded expandable metal rings somewhat conform to the inner casing's imperfections and variations and the rings somewhat conform to each other. This creates a tighter seal against fluid flowing around and through the plug than would be created by less degradable metal rings under similar conditions. A plug is designed, made and used with this advantage as an object.

In an embodiment, at least the outer surface of the expandable metal ring is comprised of or coated with a layer of aluminum, aluminum alloy or other material which partly dissolves and becomes more malleable in the presence of acidic wellbore fluids and degrades somewhat during one or more of the plug's run in, being in position before setting the plug, and after setting the plug. In an embodiment, at least one outer surface of the expandable metal ring is comprised, cladded, or coated with an aluminum or other metal or alloy or other material (such as a degradable magnesium based alloy) or composite which dissolves in acidic wellbore fluid more quickly than the rest of the plug. The dissolving outer ring surface is more malleable than the remainder of the plug and ring. It provides a sufficient seal with the inner casing wall when pressured against the inner casing wall and provides a better seal than a similar ring made of a material which does not as quickly dissolve in acid wellbore fluid.

In an embodiment, degradation of the plug and sealing element, such as aluminum, occurs if the casing fluids are acidic and/or may have a high dissolved $CO_2$ content. Many wellbore fluids are production fluids which contain dissolved carbon dioxide or hydrogen sulfide and are acidic. Alternatively, such fluids may be introduced into the borehole.

In a method, after tool setting and perfing, a fluid bearing sand or other blocking particles is introduced above the downhole tool. The sand particles work their way into and around the split ring and casing interface, clog its gaps, if any, and increase the effectiveness of the seal.

A typical metal expandable metal ring may have some irregularities on its surface. A typical inner casing wall has some irregularities on its surface. The degraded and softened outer surface of the aluminum rings conforms more completely to the inner casing wall and creates a better seal between the expandable metal ring and the inner casing wall than a metal expandable metal ring whose outer surface is not degraded and softened. In an embodiment, the initial ring/casing seal is insufficiently tight to completely halt flow of production fluid between the expandable metal ring and the inner casing wall, and further flow of production or casing fluid through unsealed areas further degrades and softens the outer surface of the expandable metal ring. In the embodiment, the expandable metal rings are under pressure squeezing them outward and the further degradation and softening of the outer surface of the rings permits them to be forced more closely against the inner casing wall, further sealing the outer surface of the rings to the inner casing wall.

Gaps between the rings and the casing and between the rings are small enough to engage and retain plugging elements, such as sand or other wellbore particles, carried by the wellbore fluid. To the extent the initial seal is insufficient to completely halt flow of production fluid between the expandable metal ring and the inner casing wall, the further flow of production completion or fracking fluid through unsealed areas may carry frac sand and debris. The frac sand and debris clog the unsealed areas between the outer surface of the split rings and the inner casing wall, further sealing the outer surface of the split rings to the inner casing wall. In one method, sand is introduced on top of the tool as or after tool is run in and set, with sufficient pressure, such as 2000 psi. In this embodiment, the sand is introduced before fracking fluid is introduced. Within a practicable amount of time, preferably within about one to two hours, the plugging elements sufficiently fill most gaps or spaces between the mandrel's outer surfaces and the parts it supports, between the expandable rings, and the inner casing wall, and around the expandable rings to substantially prevent borehole fluid from flowing through the casing past the plug.

FIGS. 3G and 3H show photos of a test where, after setting sand borne fluid pressure is applied on "top" or from left to right in the photos. Although gaps may sometimes be seen between the outer circumferences of the rings where they are forced against the inner walls of the casing, the sand particles (or proppants) appear to jam in the gaps, helping seal them. The expandable metal rings engage plugging or jamming elements, such as sand and other wellbore particles, carried by the wellbore fluid. Within a practicable amount of time, preferably within about up to one to two hours, the plugging elements sufficiently fill most spaces between the mandrel's outer surfaces and the parts it supports, between the expandable metal ring, and the inner casing wall, and around the expandable metal ring to substantially prevent borehole fluid from flowing through the casing past the plug. The initial partially softened aluminum expandable metal ring to steel inner casing wall seal is supplemented over time by the further softening of the aluminum due to the fluid flow and the clogging with debris caused by fluid flow collectively sufficiently sealing the plug against the casing so completion and production operations may be usefully undertaken.

In an embodiment, see FIG. 3F1, the wellbore may be configured to form a galvanic cell to at least partially dissolve a dissolvable metal, such as aluminum, by galvanic corrosion. The wellbore fluid, having a pH less than about 7 provides an electrolyte between the metal casing and the dissolvable aluminum plug. The metal casing of carbon steel or other steel has a galvanic potential. The dissolvable aluminum of the temporary plug is selected so the galvanic potential of the aluminum is more anodic than the metal casing. This causes the anode (plug) to dissolve at least in part by galvanic corrosion. The aluminum may be selected, for example, by selecting an alloy with a galvanic potential more anodic than that of the metal casing.

In an embodiment, see FIG. 3F1, the material of the rings, such as frusto-conical rings 222 $a^1$-$d^1$ is different from one ring to the adjacent ring. For example, the rings may be made of alternate anodic/cathodic materials. (See FIG. 3F1) Formation or downhole fluids are often electrolytic in nature. Constructing the rings of alternating material with different anodic/cathodic potentials generates electrochemical corrosion. Aluminum may be more active than the iron of the casing and act as a sacrificial anode. Moreover, the aluminum of the rings may be an alloy more active than other parts of the tool, including other aluminum parts which they contact or are in electrolytic communication. The resulting electrochemical corrosion speeds ring degradation. Further, the presence of an electrolytic fluid in an environment in which an iron casing is adjacent a different metal speeds corrosion/dissolution, especially when the rings comprise sacrificial anodes, such as aluminum alloys or magnesium alloys or relatively pure active metals.

The split ring's outer surface may be comprised of soft material or softened is made or treated with material that will soften in the well's downhole fluids. The split rings may be sticky and somewhat moldable against the inner casing wall and each other, such that in setting the tool, the split rings form an environmentally useful seal with the inner casing wall. For example, the split rings may be comprised of an aluminum which softens in acidic downhole fluids, such as those containing $CO_2$ dissolved in an aqueous solution or H2S. In some cases, fluids corrosive to aluminum are part of formation produced fluids. Such split rings in such an environment which are forced against the inner casing wall during setting of the plug provide a sufficient seal against fluid flow around the plug and a sufficient fixation of the plug to the inner casing wall.

In an embodiment, aluminum split rings 20*a*/20*b* are comprised of metal, such as an aluminum, or an aluminum alloy, which is different than the metal of which plug 10/110 is comprised. In this embodiment, the metal, such as aluminum or aluminum alloy, of split rings 20*a*/20*b* dissolves more rapidly in the presence of acidic production fluids than the metal, such as aluminum, of plug 110. In this embodiment, the aluminum of split rings 20*a*/20*b* is sufficiently soft and malleable so the split rings are capable of being squeezed outwardly against the inner casing wall during setting of the tool and sufficiently soft to usefully seal against the inner casing wall during setting of the tool, so during setting of the tool the split rings are sufficiently squeezed outwardly against the inner casing wall and sufficiently seal against the inner casing wall that the seal is a better seal than if the split rings were comprised of the aluminum of plug 110. Gaps between the split rings and the inner casing wall may be further sealed by the aluminum of the split rings dissolving in acidic fluid in the well bore over time and by particles, such as frac sand and debris, filling in gaps over time as discussed above.

The ultimately resulting seal is preferably ultimately a substantially complete seal so the plug prevents any fluid flow through the wellbore. Alternatively, the seal may be an incomplete but useful seal, not completely preventing all fluid flow through the wellbore, but nevertheless sufficiently preventing fluid flow between the plug and the casing to permit completion and production operations to be usefully undertaken.

In an embodiment, a plug with split rings is designed and constructed so it may not provide a complete seal against well fluids flowing through and around the tool, immediately upon the tool being set against the casing. The plug/casing may be seal incomplete with a flow of well fluids which is small enough to permit useful operating and production steps which require substantial, but not perfect, sealing of the zone above the tool from the zone below the tool (see FIGS. 3G and 3H). The tool is designed, constructed and set so initial fluid flow through and around the tool is large enough to sufficiently speed dissolving the dissolvable elements of the tool, so the tool dissolves quickly enough that resulting increased malleability makes the seal more complete and diminishes the flow so the remaining flow does not prevent subsequent operational and production steps. The tool is designed, constructed and set so initial fluid flow through and around the tool is large enough to sufficiently speed dissolving the dissolvable elements of the tool, so the tool dissolves quickly enough that it does not need to be drilled out or retrieved to enable taking subsequent operational and production steps which require the tool be sufficiently dissolved before they are undertaken. In an embodiment, the initial flow of fluid around the tool flows through spaces provided by an incomplete seal between the rings and the inner casing wall. In an embodiment, the initial flow of fluid through the tool flows through spaces provided by an incomplete seal between the rings and the mandrel.

In an embodiment, the plug is designed with a rapidly dissolving element which dissolves more quickly than the main bulk of the plug, the rapid dissolution of the rapidly dissolving element opening a flow path through or around the plug, the flow of fluid through or around the plug sufficiently speeding dissolution of the main bulk of the tool, so the tool dissolves quickly enough that it will not hinder subsequent operational or production steps which require the tool be sufficiently dissolved that it does not need to be drilled out or retrieved. The rapidly dissolving element may be the split rings.

E) Degradable Elastomers

Plugs often use seals comprised of rubber or a rubber-like elastomer. Milling out plugs which have rubber or rubber-like polymer seals sometimes creates problems when the milling head encounters the rubber seal. Rubber seals tend to gum up the milling head and leave gummy debris in the hole, which can create problems for a tool with dissolvable elements. Prior art elastomeric seals do not break down with desired speed or completeness. An elastomer seal which does not have to be drilled out, but rather which degrades in the presence of production fluids or fluids added from the wellhead is desirable. Such a seal may be especially desirable if used together with a plug which is otherwise generally degradable.

Applicant provides a rubber or rubber-like elastomer, which is tough but biodegradable, for use with downhole tools. Applicant provides a biodegradable rubber or rubbery substance which, in one case, may be made according to the teachings of EP 0910598 A1 (PCT/FI1997/000416, designating the U.S.) entitled "High Impact Strength Biodegradable Material," incorporated herein by reference. Another high impact strength degradable polymer is found in U.S. Pat. No. 5,756,651, incorporated herein by reference. These publications disclose a biodegradable elastomeric co-polymer consisting for the most part of high molecular weight polymers with organic hydroxyl acids and containing hydrosoluable ester bonds, and a degradable polylactic acid. They disclose a method of preparing degradable elastic co-polymers. A polylactic acid seal may be useful. Applicant believes these are sufficiently tough and durable to be used as downhole tool seals and may be used to make useful dissolvable injection molded downhole tool elastomer seals. The degradable polymer's rubbery characteristics may be optimized for use as a downhole tool seal by controlling molecular weight distribution, amount of long chain branching and cross-linking.

Figure 4D:
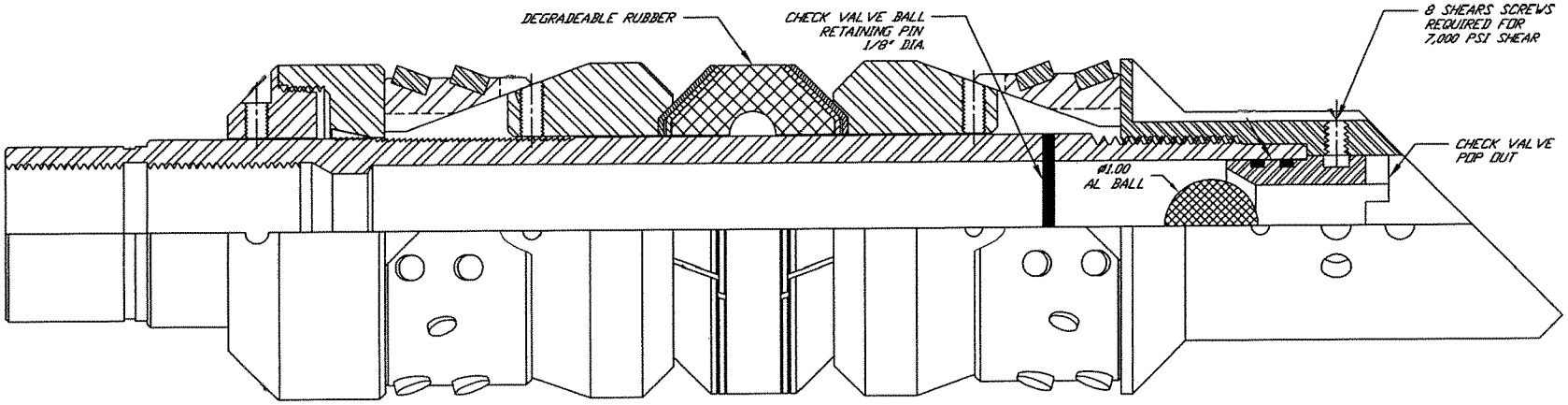

In FIGS. 4, 4D and elsewhere, a degradable rubber-like elastomer seal 132 is illustrated. Functionally and structurally, this seal may be substantially the same as elastomer seals known in the art, except that it is comprised of a degradable rubber-like material. Degradable means it will sufficiently, speedily and substantially completely degrade in at least some downhole fluids. This may include fluids added at the wellhead and production fluids. Subsequent operations and production are not as adversely affected by leaving the degradable seal in the well as leaving a similar nondegradable seal in the well. In some cases, the downhole fluids are at elevated temperatures, in one example 250° F., and elevated pressures, and may be, in part, aqueous production (formation) fluids.

Applicant discloses a degradable metallic expandable element in aluminum split rings 20*a*/20*b* and a degradable rubber and rubber-like expandable element 132 for use in any downhole tool, such as a bridge plug, frac plug, cement retainer, or packer, for sealing the tool against the inner wall of the casing. Such a tool may be an interventionless tool as set forth herein in and used in a vertical, deviated, or horizontal well and in any completion or reworking of a well, including the process of preparing a well for fracing.

Aluminum petals 134/136, which may be dissolvable as taught herein, are disposed on either side of sealing element 132, such as an expandable elastomer or other expandable element, functioning in ways known in the art to longitudinally urge elastomer 132 radially outward against the inner face in the casing and laterally inward against the mandrel to provide a fluid seal preventing fluid flow through the well casing.

F) Kit and Interchangeability

Specific downhole tools are typically ordered by operators use and specific downhole tools configured for the well are typically delivered to each well site. However, unexpected conditions sometimes make the tools delivered to the well less than optimal for the well. A kit of interchangeable parts at the well site capable of being assembled into an appropriate downhole tool for the specific well is useful.

FIGS. 6 and 6A, and 8A, 8B, 8C and 8D illustrate the interchangeability of parts on a provided subassembly with parts dimensioned to interchangeably engage the subassembly, including a mandrel 112. In one embodiment, flow back insert 142 or kill plug insert 144 are parts which may be threadably engaged onto mandrel 12/112 of a subassembly. Flow back (check valve) insert 142 of FIGS. 6 and 8A has a body 142*a* with an outer threaded section to engage inner threaded section on the near end of the mandrel, a small ball 142*b* and keeper pin 142*c*. Installed on the tool, it may be run in with the tool, and is similar to the captured ball of FIGS. 9A and 9B, except the ball seat has a smaller diameter. Kill plug insert 144 creates a bridge plug which permits no flow up or down.

In an embodiment, Applicant provides a subassembly, including setting elements 146, which may be setting elements (anchor elements such as slips, seal or pack off elements) known in the art or the setting elements disclosed herein, which setting elements function to set the tool sealingly in the casing in ways known in the art by moving elements (slips, wedges, cones, petals) longitudinally on the mandrel by setting or squeezing one or more elastomer seals or split rings outwardly against the inner wall of the tubing or casing. A parts kit is provided which comprises multiple elements, including multiple top elements 148 and/or multiple bottom elements 150, which top and bottom elements may be adapted to engage the exterior of the mandrel with set screws, threads, shear pins or a combination thereof or in any fixed manner at the top and/or bottom of the mandrel. In one embodiment, top elements may be a top ring and/or load ring or a top sub and bottom element 150 may be a bottom sub, which may include a wedge or a pump out ring assembly. A first kit is a base kit upon which a second kit, including multiple interchangeable elements adapted to interchange upon at least the mandrel of the first kit, allow a user to adapt the mandrel and packing elements "on the fly" at a well sits for multiple uses.

In one embodiment of Applicant's downhole tool and in one embodiment of an all-aluminum downhole tool, a kit is provided with interchangeable parts which comprises at least a mandrel and one or more of the following setting elements (which anchor and/or seal): namely, slips, cones, elastomers, and backup petals. A kit is a set of parts packaged together with or without a common subassembly, the parts related in that the parts interchangeably engage the kits' subassembly. The mandrel may come with a kit including a top ring and a bottom sub configured to fit on the mandrel, and the kit may have additional parts, which parts may be interchangeably added to the mandrel and setting elements to change the function of the downhole tool. The parts may include: bottom subassemblies and top assemblies that allow for mechanical setting, pump out or that allow for conversion of the bridge plug to a kill plug for use in the well casing or at the well casing bottom; flow back insert 142 (FIGS. 6 and 8A) kill plug insert 144 (FIGS. 6 and 8B); run in ball assembly of FIGS. 9A and 9B and pump out ring assembly of FIGS. 6, 8C and D.

H) Interventionless Tool Method.

Plugs are "interventionless" if they do not require milling out or retrieval to sufficiently remove them from the well so completion can continue, but rather may be left in the well where they disintegrate or dissolve to the same effect. Using interventionless downhole plugs saves time and expense in well completion and work over processes, including fracing and/or acid completions.

Figure 10A:
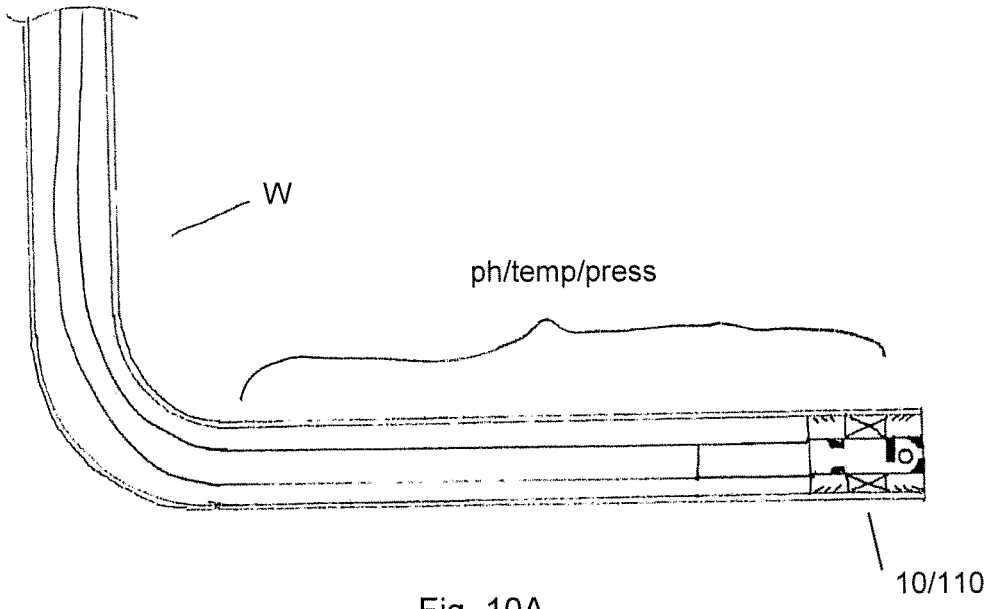
FIGS. 10A-E illustrate an interventionless method of fracking and completing a well.
Figure 10B:
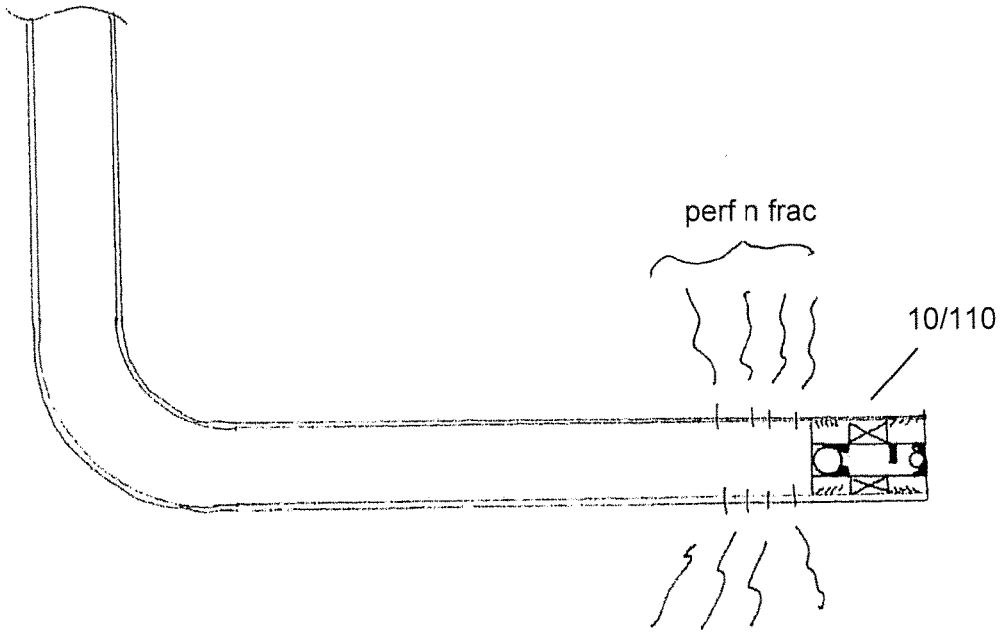
Figure 10C:
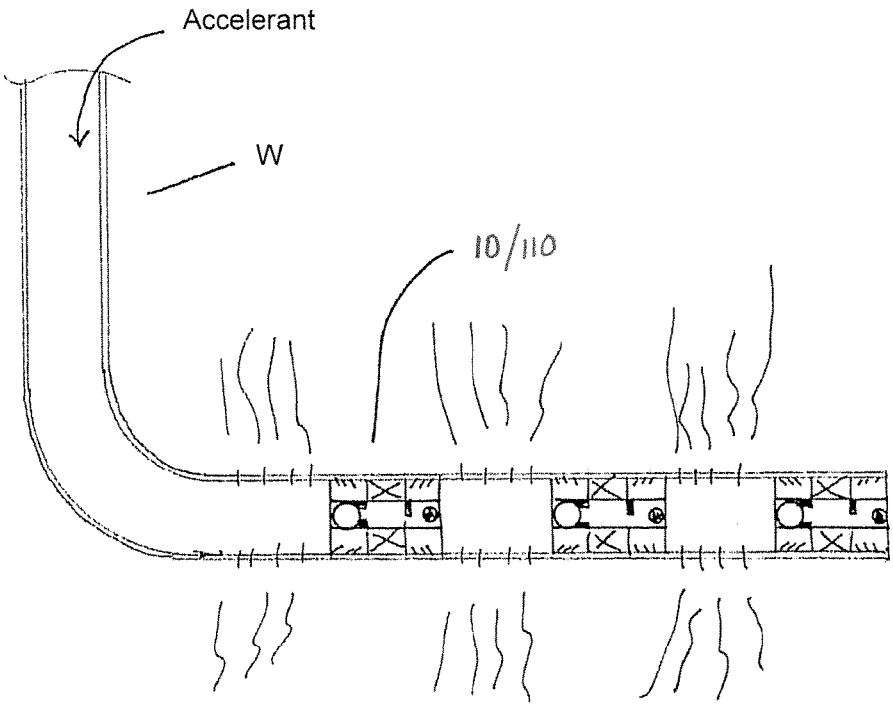
Figure 10D:
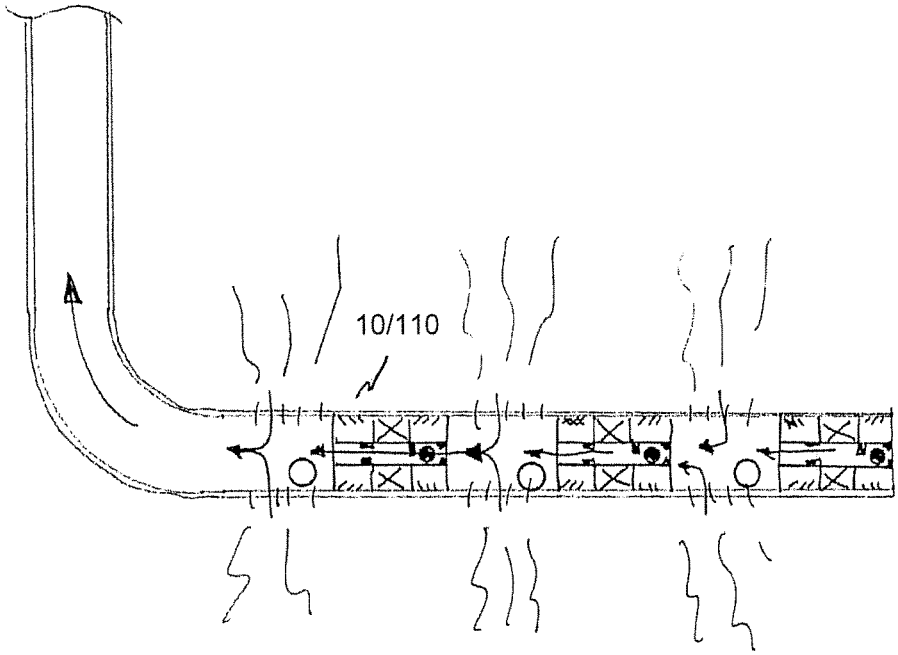
Figure 10E:
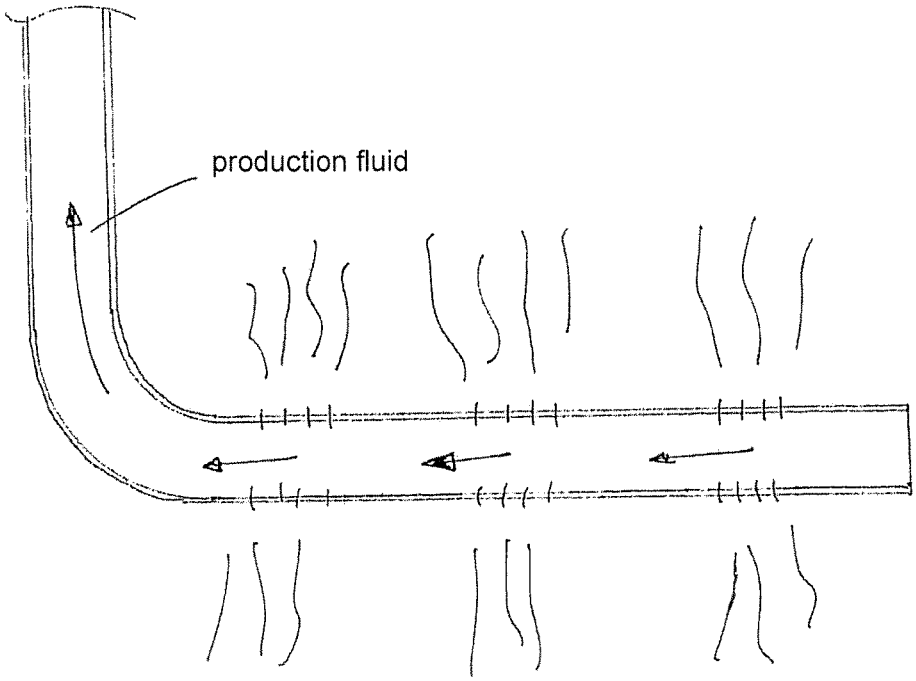

In FIGS. 10A to 10E, a method of using the aluminum plug is disclosed which eliminates milling out or retrieval. In FIG. 10A, an initial determination of pH, temperature and pressure at the production zones is made using methods known in the art. In FIG. 10B, an initial frac plug is set and the casing is perfed and fracked. In one embodiment, sand, sintered bauxite, ceramics or other proppants are introduced during hydraulic fracturing steps 10B and 10C, which help seal the tool in the casing as disclosed herein. In FIG. 10C, additional "uphole" production zones are perfed and fracked (with or without proppants and/or acid) while previously set plugs are seen progressively deteriorating. In FIG. 10D, production has commenced and any plug that has not lost functionality nevertheless still allows production flow "uphole". FIG. 10E shows full plug dissolution, no more functionality in the plugs, with some of the aluminum or other degradable elements (such as polyglycolic acid) being removed from the hole by production fluid. At any step, an accelerant (see FIG. 10C) may be added to increase the rate of dissolution of the plug. The dissolved methods may be practiced as part of a fracing operation in a well that has a horizontal section.

The method includes use of a dissolvable plug in a well having production fluids capable of dissolving the plug, such as fluids with sufficient $CO_2$ or $H_2S$, which make the fluid sufficiently acidic that over time (about two to three hours to two to three weeks), the dissolvable elements of the tool dissolve sufficiently to remove the need to drill out or remove the plug in a practicable period of time. A prior art method and structure is shown in United States patent publication No. US2011/0048743, which is incorporated herein by reference. In an embodiment of Applicant's dissolvable aluminum bridge plug and method, a chemical, such as and acid—like HCl may be added at the wellhead and communicated to the plug to speed dissolution of the plug. In a preferred composition and method, the plug sufficiently dissolves in less than two days to permit fluid flow through the borehole so it does not unduly delay the next completion step.

In a preferred method, the plug is an aluminum bridge plug capable of being used in a well fracing process. In one preferred embodiment, all elements of the plug are made of aluminum, except bottom ball 27 and/or top frac ball 30, which may be made of aluminum, metallic or non-metallic composite, a dissolvable material, such as PGA (polyglycolic acid polymer) or any other suitable dissolvable material. In another embodiment, the entire "non-ball" portion of the tool may be comprised of aluminum or aluminum alloy, except the buttons or inserts 19 on slips 18. The preferred aluminum elements are not composite and do not contain sintered elements, other metals or compounds. The preferred aluminum may be aluminum or aluminum alloy, non-sintered and non-composite.

In a method of using a downhole tool, illustrated in FIGS. 10A-10E, a tool 10/110 having dissolvable elements and/or a split ring assembly is disposed in a well W (which may have vertical and lateral segments), used for its intended purpose and then left in the well, where, because its dissolvable elements dissolve, it does not adversely interfere with subsequent operations and production as much as would a similar tool without dissolvable elements. In a method, the structure and materials of the dissolvable elements are determined and one or more of the acidity, temperature and pressure of the fluid at intended downhole location of the downhole tool is determined prior to disposing the tool into the well, and the determinations used to calculate when the dissolvable tool will be sufficiently dissolved so subsequent operations or production may usefully begin without drilling out or retrieving the downhole tool, and such subsequent operations or production begin after the calculated time without drilling out or retrieving the downhole tool.

A method wherein one or more of the acidity, temperature, and/or pressure of the fluid in a well where a downhole tool is to be located is determined, and the desired duration interval from insertion or use of the downhole tool in the well until the next operation or production with which the downhole tool would interfere is determined, and well's determined measurements and the desired duration interval are used to choose or adjust at least one structure and at least one material of the downhole tool's structures and materials, so the downhole tool will be sufficiently stable to accomplish its function in the well and will also dissolve sufficiently quickly enough after accomplishing its function that the next operation or production may be timely undertaken without the necessity of drilling out or retrieving the tool.

In one preferred embodiment, balancing the cost of rig time on site while waiting for the plug to dissolve against the cost of milling out the plug without delay, the practical period of time for the plug to dissolve is between a few hours and two days. If, for a particular well, additional well completion work below the plug is unnecessary for an extended period of time, then the time for dissolution of the plug which is practical for that well may be increased to that extended period of time, ranging from two days to two months. A useful wellbore fluid is preferably acidic, having a pH less than 7 pH. Greater acidity speeds dissolution of the disclosed plugs. A more preferable fluid has a pH less than 5, or a range of pH from 4-5. The preferable duration for the plug to dissolve in the well is determined before choosing to use the plug in the well and is used in choosing which dissolvable plug with which structures and materials to employ. After the plug is placed in the well and used, the next step of well completion is delayed until expiration of the determined duration for plug dissolution, that is, the time between immersing the plug in the wellbore fluid and the plug ceasing to prevent the next step of well completion due to the plug dissolving. In a preferred composition and method, the plug sufficiently dissolves in less than two days to permit fluid flow through the borehole.

A method of using the disclosed aluminum plug 10/110 is to determine the aluminum plug's dissolvablability characteristics, volume of formation fluid flow, fluid temperature and acidity of the formation fluid to determine when the particular aluminum plug being used in the particular well will be sufficiently dissolved after insertion into the well for the subsequent targeted purpose. The subsequent targeted purpose may be further completion work without needing to drill out or remove the plug, production of the well without needing to drill out or remove the plug, or permanently leaving the plug in the well.

In an embodiment, the sealing element is an all metal/metallic sealing element adapted to form a metal-metal seal between the plug and the casing without a rubber or elastomeric sealing element associated with the metal seal. The metal sealing element substantially forms a seal, not necessarily fluid-tight, but sufficient to seal against the flow of a frac proppant or other particulate, so that the flow of fluid carries frac proppant or other particulate to the incomplete seal where it packs off the seal to form a substantially fluid-tight seal.

It is seen that the aluminum (or other suitable metallic or non-metallic) expandable metal rings, degradable elastomers, kit and interchangeability as well as the bottom pump out ring, with or without the top ball and other embodiments and methods disclosed herein, function synergistically to create alternative plugs and methods of using them. They are additionally "stand alone" features applicable other downhole set tools. Embodiments herein are can be used independently or can be combined.

All ranges disclosed herein are inclusive of the endpoints, and the endpoints are independently combinable with each other. The suffix "(s)" as used herein is intended to include both the singular and the plural of the term that it modifies, thereby including at least one of that term (e.g., the colorant (s) includes at least one colorants). "Optional" or "optionally" means that the subsequently described event or circumstance can or cannot occur, and that the description includes instances where the event occurs and instances where it does not. As used herein, "combination" is inclusive of blends, mixtures, alloys, reaction products, and the like. All references are incorporated herein by reference.

The use of the terms "a" and "an" and "the" and similar referents in the context of describing the invention (especially in the context of the following claims) are to be construed to cover both the singular and the plural, unless otherwise indicated herein or clearly contradicted by context. As used herein, the term "a" includes at least one of an element that "a" precedes, for example, "a device" includes "at least one device." "Or" means "and/or." Further, it should further be noted that the terms "first," "second," and the like herein do not denote any order, quantity (such that more than one, two, or more than two of an element can be present), or importance, but rather are used to distinguish one element from another. The modifier "about" used in connection with a quantity is inclusive of the stated value and has the meaning dictated by the context (e.g., it includes the degree of error associated with measurement of the particular quantity).

Certain embodiments and features have been described using a set of numerical upper limits and a set of numerical lower limits. It should be appreciated that ranges including the combination of any two values, e.g., the combination of any lower value with any upper value, the combination of any two lower values, and/or the combination of any two upper values are contemplated unless otherwise indicated. Certain lower limits, upper limits, and ranges may appear in one or more claims below. All numerical values are "about" or "approximately" the indicated value, and take into account experimental error and variations that would be expected by a person having ordinary skill in the art.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

Although the invention has been described with reference to a specific embodiment, this description is not meant to be construed in a limiting sense. On the contrary, various modifications of the disclosed embodiments will become apparent to those skilled in the art upon reference to the description of the invention. It is therefore contemplated that the appended claims will cover such modifications, alternatives, and equivalents that fall within the true spirit and scope of the invention.

The invention claimed is:

1. A kit for providing multiple settable downhole tool configurations on a common subassembly, the tool adapted to seal against the inner wall of a casing in a well, the common subassembly comprising a mandrel having a first end and second end, an exterior surface, and an interior surface and including a ball seat, a slip, a wedge, and a sealing element entrained on the outer surface of the mandrel, the kit including:

a top ring dimensioned to engage the upper mandrel;

a bottom sub for engaging the lower mandrel;

a sealing element for being located about the mandrel and for forming and at least substantially fluid tight seal between the tool and the casing;

a pump-out ring assembly including a pump-out ring having a ball seat, a pump-out ring ball and shear elements, the pump-out ring assembly configured for being coupled to the lower end of the mandrel or the bottom sub by inserting a chosen number of shear elements inserted through the mandrel or bottom sub and into the pump-out ring assembly, and to be decoupled from the mandrel or the bottom sub when downward hydrostatic pressure in the well on the assembled downhole tool exceeds a preset release downward hydrostatic pressure and shears the shear elements between the mandrel or bottom sub and the pump-out ring assembly;

a keeper pin for keeping the pump-out ring ball from flowing upward and out of the mandrel;

when the kit is assembled into a settable downhole tool and immersed in the well's wellbore fluid, the pump-out ring assembly is coupled by shear elements to the mandrel and, upon receipt of the pump-out ring ball into the pump-out ring ball seat, prevents downward fluid flow through the mandrel until the downward hydrostatic pressure on the tool exceeds the preset release downward hydrostatic pressure, the shear elements then shearing and the pump-out ring assembly then decoupling from the mandrel or the bottom assembly, to open the mandrel to downward fluid flow through the mandrel; and changing the number of shear elements to couple the pump-out ring assembly with the mandrel or the bottom sub when assembling the tool will change the preset release downward hydrostatic pressure.

2. A settable downhole tool for temporarily isolating a zone above the tool from a zone below the tool in a cased well, the tool comprising:

a mandrel;

one or more elements for holding the tool to the casing and sealing the tool to the casing; and a pump-out ring assembly located within or near the lower end of the mandrel, coupled to the mandrel, either with or without a bottom assembly located between the pump-out ring assembly and the mandrel; and comprising a pump-out ring with a ball seat, and one or more shearable shear elements, fluid may flow through the ball seat and the mandrel when the ball seat is open;

fluid may not flow downward through the ball seat and the mandrel when a ball is seated in the ball seat, a seated ball in the ball seat when the pump-out ring assembly is coupled to the mandrel isolating a zone below the tool from downward fluid flow from a zone above the tool;

the one or more shear elements couple the pump-out ring assembly to the mandrel;

the minimum relative downward hydrostatic pressure on the pump-out assembly needed to shear the shear elements coupling the pump-out ring assembly to the mandrel is the first release downward hydrostatic pressure;

the cumulative number and the shear strength of the one or more shear elements coupling the pump-out ring assembly to the mandrel determine, in part, the first release downward hydrostatic pressure;

the tool is comprised so the number and strength of the one or more shear elements is selected and inserted into the tool before the tool enters the well;

responsive to a first relative downward hydrostatic pressure on the tool, which is less than the first release downward hydrostatic pressure, the ball is in pump-out ring's ball seat and the mandrel is closed; and responsive to a second relative hydrostatic pressure on the tool, which is equal to or greater than the first release downward hydrostatic pressure, the one or more shear elements shear, decoupling the pump-out ring assembly from the mandrel, and opening the mandrel to downward fluid flow.

3. The tool of claim 2, further comprising:

at least one hole in the mandrel or the bottom assembly extends through the mandrel or the bottom assembly;

at least one hole in the outer surface of the pump-out ring;

the at least one hole in the mandrel or the bottom assembly corresponds to the at least one hole in the pump-out ring assembly;

at least one shear element located in the at least one hole in the mandrel or bottom assembly and extending into the corresponding at least one hole in the outer surface of the pump-out ring assembly; and the at least one shear element couples the pump-out ring assembly to the mandrel; and shearing the shear element will decouple the pump-out ring assembly from the mandrel.

4. The tool of claim 3, further comprising:

multiple holes in the mandrel or the bottom assembly which extend through the mandrel or the bottom assembly;

multiple holes in the outer surface of the pump-out ring;

at least some of the holes in the mandrel or the bottom assembly correspond to at least some of the holes in the pump-out ring assembly;

multiple shear elements located in at least some of the multiple holes in the mandrel or bottom assembly and extending into multiple corresponding holes in the outer surface of the pump-out ring assembly;

the multiple shear elements extending through the mandrel or the bottom assembly and into the pump-out assembly coupling the pump-out ring assembly to the mandrel; and shearing the shear elements will decouple the pump-out ring assembly from the mandrel.

5. The tool of claim 4 wherein the number of shear elements inserted from the mandrel or the bottom assembly and into the pump-out ring holes may be selected at the well site and the shear elements inserted into the tool at the wellsite to correspond to a selected release downward hydrostatic pressure.

6. The tool of claim 3 wherein inserting shear elements with a relatively higher shear strength produces a higher release downward hydrostatic pressure needed to decouple the pump-out ring assembly from the mandrel.

7. The tool of claim 2 wherein inserting a higher number of the shear elements from the mandrel or the bottom assembly into the pump-out ring holes produces a higher release downward hydrostatic pressure needed to decouple the pump-out ring assembly from the mandrel.

8. The tool of claim 2 wherein not all of the tool's pump-out ring hole and mandrel or bottom assembly hole pairs contain a shear element.

9. The tool of claim 2 wherein the shear elements are shear screws or shear pins and at least two shear screws or shear pins are used in the tool, each is made of metal, and each has shear strength in the range of 800 to 1100 PSI.

10. The tool of claim 2 further comprising the pump-out assembly having a keeper located above the ball seat for keeping a ball below the keeper, and a ball located between the keeper and the ball seat.

11. The tool of claim 2 further comprising the bottom subassembly engaged with the mandrel, and coupled by the shear elements with the pump-out assembly.

12. The tool of claim 11 further comprising the pump-out assembly having a keeper located above the ball seat for keeping a ball below the keeper, and a ball located between the keeper and the ball seat.

13. The downhole tool of claim 2, further comprising an upper ball seat located at the upper end of the mandrel and configured to receive an upper ball after the tool is set and seal the mandrel against downward fluid flow through the mandrel.

14. A settable downhole tool for temporarily isolating a zone above the tool from a zone below the tool in a cased well, the tool comprising:

a mandrel;

one or more elements for holding the tool to the casing and sealing the tool to the casing;

a bottom subassembly engaged with the mandrel;

a pump-out ring assembly comprising a pump-out ring with a ball seat, and multiple shearable shear elements, namely shear screws or shear pins;

multiple holes in the bottom assembly which extend through the bottom assembly, and multiple holes in the outer surface of the pump-out ring, wherein at least some of the holes in the bottom assembly correspond to at least some of the holes in the pump-out ring assembly;

multiple shear elements inserted in at least some of the holes in the bottom assembly and extending into at least some of the corresponding holes in the outer surface of the pump-out ring assembly;

the shear elements extending through the bottom assembly and into the pump-out assembly couple the pump-out ring assembly to the mandrel;

the cumulative number and shear strength of the shear elements coupling the pump-out ring assembly to the mandrel determine, at least in part, a first release downward hydrostatic pressure needed to shear the shear elements and decouple the pump-out ring assembly from the mandrel;

the first release downward hydrostatic pressure is settable before the tool enters the well by varying the number and strength of the shear elements inserted into the tool;

fluid may flow through the ball seat and the mandrel when the ball seat is open;

fluid may not flow downward through the mandrel and ball seat when a ball is seated in the ball seat, and the pump-out ring assembly is coupled to the mandrel, the tool then isolating a zone below the tool from downward fluid flow from a zone above the tool;

responsive to a first downward hydrostatic pressure on the tool which is less than the first release downward hydrostatic pressure, the mandrel remains closed, and the tool continues to isolate a zone below the tool from downward fluid flow from a zone above the tool;

responsive to a second hydrostatic pressure on the tool, which is equal to or greater than the first release downward hydrostatic pressure, the shear elements shear, decoupling the pump-out ring assembly from the mandrel, and opening the mandrel so the tool will permit downward fluid flow from the zone above the tool into a zone below the tool.

15. The tool of claim 14 wherein the tool is capable of having number of shear elements inserted into the pump-out ring holes at the well site to correspond to a selected release downward hydrostatic pressure for the well and to have the selected number of the shear elements inserted into the pump-out ring holes at the wellsite so the pump-out ring will decouple from the mandrel at the selected release downward hydrostatic pressure.

16. The tool of claim 14 further comprising the pump-out assembly having a keeper located above the ball seat for keeping a ball below the keeper, and a ball located between the keeper and the ball seat.

17. A kit for providing a settable downhole tool for temporarily isolating a zone above the tool from a zone below the tool in a well, the kit comprising a mandrel, and one or more elements for holding the tool to the casing and sealing the tool to the casing; further comprising:

a pump-out ring assembly located near the lower end of the mandrel, coupled to the mandrel, and comprising a pump-out ring with a ball seat, and one or more shearable shear elements;

wherein fluid may flow through the ball seat and the mandrel when the ball seat is open;

wherein fluid may not flow downward through the ball seat and the mandrel when a ball is seated in the ball seat, a seated ball in the ball seat when the pump-out ring assembly is coupled to the mandrel isolating a zone below the tool from downward fluid flow from a zone above the tool;

wherein the one or more shear elements couple the pump-out ring assembly to the mandrel;

wherein the minimum downward hydrostatic pressure on the pump-out assembly needed to shear the shear elements coupling the pump-out ring assembly to the mandrel is the first release downward hydrostatic pressure;

multiple holes in the mandrel or the bottom assembly which extend through the mandrel or the bottom assembly, and multiple holes in the outer surface of the pump-out ring, and at least some of the holes in the mandrel or the bottom assembly correspond to at least some of the holes in the pump-out ring assembly;

multiple shear elements located in at least some of the multiple holes in the mandrel or bottom assembly and extending into multiple corresponding holes in the outer surface of the pump-out ring assembly;

the multiple shear elements extending through the mandrel or the bottom assembly and into the pump-out assembly coupling the pump-out ring assembly to the mandrel;

wherein the cumulative number and shear strength of the one or more shear elements coupling the pump-out ring assembly to the mandrel determine; at least in part, the first release downward hydrostatic pressure;

wherein the number and shear strength of the one or more shear elements can determined before the tool is put into the well and the selected shear elements can be inserted into the tool before it is put into the well;

wherein responsive to a first downward hydrostatic pressure on the tool, which is less than a first release downward hydrostatic pressure, the mandrel remains closed;

wherein responsive to a second hydrostatic pressure on the tool, which is equal to or greater than a first release downward hydrostatic pressure, the one or more shear elements shear, decoupling the pump-out ring assembly from the mandrel, and opening the mandrel to downward fluid flow;

wherein changing the number of shear screws to couple the pump-out ring assembly with the mandrel or a bottom assembly when assembling the tool changes the preset release downward hydrostatic pressure;

wherein the pump-out ring may couple with the bottom assembly through multiple possible combinations of shear elements, and the assembled tool's selected combination of the shear elements provides can provide a selected preset release downward hydrostatic pressures.

18. A method of making a downhole tool for temporarily isolating a zone above the tool from a zone below the tool in a hydrocarbon well, the method comprising the steps of:

providing the components of the tool of claim 7, including a mandrel and one or more elements for holding the tool to the casing and sealing the tool to the casing;

providing a pump-out ring assembly located near the lower end of the mandrel, coupled to the mandrel, and comprising a pump-out ring with a ball seat, and one or more shearable shear elements;

wherein fluid may flow through the ball seat and the mandrel when the ball seat is open;

wherein fluid may not flow downward through the ball seat and the mandrel when a ball is seated in the ball seat, a seated ball in the ball seat when the pump-out ring assembly is coupled to the mandrel isolating a zone below the tool from downward fluid flow from a zone above the tool;

wherein the one or more shear elements couple the pump-out ring assembly to the mandrel;

wherein the minimum downward hydrostatic pressure on the pump-out assembly needed to shear the shear elements coupling the pump-out ring assembly to the mandrel is the first release downward hydrostatic pressure;

multiple holes in the mandrel or the bottom assembly which extend through the mandrel or the bottom assembly, and multiple holes in the outer surface of the pump-out ring, and at least some of the holes in the mandrel or the bottom assembly correspond to at least some of the holes in the pump-out ring assembly;

multiple shear elements located in at least some of the multiple holes in the mandrel or bottom assembly and extending into multiple corresponding holes in the outer surface of the pump-out ring assembly;

the multiple shear elements extending through the mandrel or the bottom assembly and into the pump-out assembly coupling the pump-out ring assembly to the mandrel;

wherein the cumulative number and shear strength of the one or more shear elements coupling the pump-out ring assembly to the mandrel determine the first release downward hydrostatic pressure;

wherein the number and strength of the one or more shear elements is determined before the tool enters the well;

wherein responsive to a first downward hydrostatic pressure on the tool, which is less than a first release downward hydrostatic pressure, the mandrel remains closed;

wherein responsive to a second hydrostatic pressure on the tool, which is equal to or greater than a first release downward hydrostatic pressure, the one or more shear elements shear, decoupling the pump-out ring assembly from the mandrel, and opening the mandrel to downward fluid flow;

wherein the pump-out ring may couple with the bottom subassembly through multiple possible combinations of shear elements for the unassembled tool, and the assembled tool's selected combination of the shear elements providing multiple possible preset release downward hydrostatic pressures; and selecting the number of shear screws to couple the pump-out ring assembly with the mandrel or a bottom sub when assembling the tool to set the preset release downward hydrostatic pressure; and assembling the components to produce the tool of claim 7.

19. A method of fracing, completing and producing a well comprising the steps of:

providing the tool of claim 14 to a well site;

selecting and installing shear elements into the tool at the wellsite to set the tool's preset release hydrostatic downward pressure;

setting the tool of claim 14 in the well;

using the tool to isolate a zone above the tool from a zone below the tool;

fracing a zone above the tool;

applying downward hydraulic pressure on the tool which exceeds the shear strength of the pump-out ring's shear elements, shearing the tool's shear elements in opening the tool's mandrel to downward fluid flow through it; and completing and producing the well.

* * * * *